US011912456B2

(12) United States Patent
Yamane et al.

(10) Patent No.: US 11,912,456 B2
(45) Date of Patent: Feb. 27, 2024

(54) BAGMAKING AND PACKAGING DEVICE AND TUBE MEMBER FOR BAGMAKING AND PACKAGING DEVICE

(71) Applicant: ISHIDA CO., LTD., Kyoto (JP)

(72) Inventors: Masayuki Yamane, Ritto (JP); Makoto Ichikawa, Ritto (JP); Satoshi Hashimoto, Ritto (JP); Ryuichi Kurosawa, Ritto (JP); Rintaro Moritani, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 0 days.

(21) Appl. No.: 17/686,418

(22) Filed: Mar. 4, 2022

(65) Prior Publication Data

US 2022/0289411 A1 Sep. 15, 2022

(30) Foreign Application Priority Data

Mar. 11, 2021 (JP) ..... 2021-039301

(51) Int. Cl.
*B65B 9/20* (2012.01)
*B65B 51/30* (2006.01)
*B65B 31/04* (2006.01)

(52) U.S. Cl.
CPC ..... *B65B 9/2056* (2013.01); *B65B 9/20* (2013.01); *B65B 9/2028* (2013.01); *B65B 31/045* (2013.01); *B65B 51/303* (2013.01)

(58) Field of Classification Search
CPC ..... B65B 9/20; B65B 9/2028; B65B 9/2056; B65B 31/045; B65B 51/303
(Continued)

(56) References Cited

U.S. PATENT DOCUMENTS 3,788,368 A * 1/1974 Geng et al. ..... B65B 63/028 141/93
4,128,985 A * 12/1978 Simmons ..... B65B 9/2028 53/551
(Continued)

FOREIGN PATENT DOCUMENTS

JP 2004210297 A * 7/2004
JP 2011006140 A * 1/2011
(Continued)

OTHER PUBLICATIONS

Search Report from the corresponding European Patent Application No. 22160043.0 dated Jul. 28, 2022.

*Primary Examiner* — Stephen F. Gerrity
(74) *Attorney, Agent, or Firm* — SHINJYU GLOBAL IP

(57) ABSTRACT

A bagmaking and packaging device includes a transverse sealing unit, a first tube member, and a gas flow path member. The first tube member is disposed above the transverse sealing unit and extends in an up and down direction. The first tube member allows a packaging material to become wrapped around it to thereby form the packaging material into a tubular shape. At least part of the gas flow path member is disposed inside the first tube member. The gas flow path member delivers nitrogen into the packaging material formed into the tubular shape. The first tube member includes a cutout portion that extends in the up and down direction. The cutout portion is formed so that the nitrogen can move between a space between the packaging material formed into the tubular shape and the first tube member and the inside space of the first tube member.

7 Claims, 21 Drawing Sheets

(58) Field of Classification Search
USPC ..... 53/433, 451, 511, 551
See application file for complete search history.

(56) References Cited

U.S. PATENT DOCUMENTS

| | | | | |
|---|---|---|---|---|
| 4,620,409 | A * | 11/1986 | McElvy | B65B 9/2028 53/551 |
| 4,738,287 | A * | 4/1988 | Klinkel | B65B 9/213 53/511 |
| 6,179,015 | B1 * | 1/2001 | Kammler et al. | B65B 9/20 141/94 |
| 6,220,000 | B1 * | 4/2001 | Kammler et al. | B65B 9/20 53/511 |
| 6,619,018 | B1 | 9/2003 | Sasaki | |
| 2005/0188660 | A1 * | 9/2005 | Kondo et al. | B65B 9/22 53/551 |
| 2012/0198799 | A1 | 8/2012 | Nishitsuji et al. | |

FOREIGN PATENT DOCUMENTS

| | | | |
|---|---|---|---|
| JP | 2012062111 | A | 3/2012 |
| JP | 2015-127239 | A | 7/2015 |

* cited by examiner

BAGMAKING AND PACKAGING DEVICE AND TUBE MEMBER FOR BAGMAKING AND PACKAGING DEVICE

CROSS-REFERENCE TO RELATED APPLICATION

This application claims priority to Japanese Patent Application No. 2021-039301, filed Mar. 11, 2021. The contents of that application are incorporated by reference herein in their entirety.

TECHNICAL FIELD

The present invention relates to a bagmaking and packaging device that uses an inert gas and to a tube member for the bagmaking and packaging device.

BACKGROUND ART

JP-A No. 2015-127239 discloses a bagmaking and packaging device that uses an inert gas. The bagmaking and packaging device has a tube member around which a sheet-like packaging material becomes wrapped. In the tube member is a passage for allowing an inert gas such as nitrogen to pass through it. The passage has the function of replacing gas inside a bag with the inert gas. The inert gas passes through the passage and is discharged from a discharge outlet in the lower end of the tube member. Because of this, air including oxygen in the bag is replaced with the inert gas.

BRIEF SUMMARY

In the bagmaking and packaging device, there is a gap between the tube member around which the packaging material becomes wrapped and the packaging material. Some of the inert gas passes through this gap and flows from the inside of the packaging material to the outside. If the outflow quantity of the inert gas is large, the needed supply quantity of the inert gas increases and the running costs required for bagmaking and packaging become higher.

It is a goal of the present invention to reduce the supply quantity of an inert gas in a bagmaking and packaging device.

A bagmaking and packaging device pertaining to a first aspect includes a transverse sealing unit, a first tube member, and an inert gas flow path member. The transverse sealing unit transversely seals a packaging material formed into a tubular shape. The first tube member is disposed above the transverse sealing unit and extends in an up and down direction. The first tube member allows the packaging material to become wrapped around it to thereby form the packaging material into the tubular shape. The first tube member guides downward contents entering the first tube member from above. At least part of the inert gas flow path member is disposed inside the first tube member. The inert gas flow path member delivers an inert gas into the packaging material formed into the tubular shape. In the first tube member is formed a slot-shaped cutout portion that extends in the up and down direction. The cutout portion is formed so that the inert gas can move between a space between the packaging material formed into the tubular shape and the first tube member and the inside space of the first tube member.

In the bagmaking and packaging device of the first aspect, the cutout portion is formed in the first tube member, and the inert gas moves via the cutout portion. Because of this, some of the inert gas moves from the space between the packaging material and the first tube member to the inside space of the first tube member, and thus the quantity of the inert gas that flows from the space between the packaging material and the first tube member to the outside of the tubular packaging material decreases. For this reason, in this bagmaking and packaging device, the supply quantity of the inert gas can be reduced.

A bagmaking and packaging device of a second aspect is the bagmaking and packaging device of the first aspect and further includes a second tube member and an opening/closing member. The second tube member is disposed above the first tube member. The opening/closing member is disposed above the first tube member. The opening/closing member and the second tube member form a retention space for temporarily retaining the contents.

In the bagmaking and packaging device of the second aspect, the second tube member is disposed above the inside space of the first tube member, and the retention space is temporarily formed above the first tube member. When the retention space is formed by the opening/closing member and the second tube member, the top of the inside space of the first tube member is closed off by the opening/closing member. In this state, much of the inert gas delivered into the packaging material heads to the space between the packaging material and the first tube member.

However, in this bagmaking and packaging device, as described above, the inert gas can move from the space between the packaging material and the first tube member via the cutout portion to the inside space of the first tube member. For this reason, in the bagmaking and packaging device of the second aspect also, the supply quantity of the inert gas can be reduced.

A bagmaking and packaging device of a third aspect is the bagmaking and packaging device of the second aspect and further includes an air delivery unit and a control unit. The air delivery unit delivers air from above to the inside space of the first tube member. The control unit controls the air delivery unit and the opening/closing member. The control unit, when it has switched the opening/closing member from an open state to a closed state, uses the air delivery unit to deliver air to the inside space of the first tube member.

In the bagmaking and packaging device of the third aspect, air is delivered from above to the inside space of the first tube member when the opening/closing member has switched from the open state to the closed state. Because of this, when the opening/closing member switches from the open state to the closed state and the contents that had been temporarily retained in the retention space are dropping to the inside space of the first tube member that is below the opening/closing member, the air delivered by the air delivery unit accelerates the drop speed of the contents and inhibits variations in the drop speed.

A bagmaking and packaging device of a fourth aspect is the bagmaking and packaging device of the third aspect, wherein the inert gas supply quantity is 0.8 times to 1.2 times the air supply quantity. The inert gas supply quantity is the quantity per unit of time of the inert gas delivered into the packaging material formed into the tubular shape. The air supply quantity is the quantity per unit of time of the air delivered to the inside space of the first tube member by the air delivery unit.

In the bagmaking and packaging device disclosed in JP-A No. 2015-127239 cited above, inert gas is supplied by the flow path formed in the tube member that allows the packaging material to become wrapped around it, and inert gas is also delivered downward from outlets separate from the flow path. As an example, inert gas supply quantities of 220 liters/minute and 300 liters/minute are disclosed.

However, the larger the needed inert gas supply quantity is, the higher the running costs of the bagmaking and packaging device become.

In light of this, the bagmaking and packaging device of the fourth aspect employs a configuration that does not deliver just the inert gas but also uses the air delivery unit to deliver air, and sets the inert gas supply quantity to 0.8 times to 1.2 times the air supply quantity. The air delivery unit is given the role of accelerating the drop speed of the contents and inhibiting variations in the drop speed, while the inert gas flow path member is given the role of replacing the gas in the bag with the inert gas. Because of this, in the bagmaking and packaging device of the fourth aspect, the supply quantity of the inert gas can be further reduced.

A bagmaking and packaging device of a fifth aspect is the bagmaking and packaging device of any of the first aspect to the fourth aspect, wherein the cutout portion formed in the first tube member extends upward from a lower end of the first tube member.

In the bagmaking and packaging device of the fifth aspect, machining for forming the cutout portion in the first tube member becomes easy to perform, and fewer man-hours are needed to manufacture the first tube member.

A bagmaking and packaging device of a sixth aspect is the bagmaking and packaging device of any of the first aspect to the fifth aspect, wherein a transverse section of the first tube member at a height position of the part where the cutout portion is formed is substantially C-shaped.

In the bagmaking and packaging device of the sixth aspect, the cutout portion can be formed in the first tube member while ensuring that the first tube member is high in strength.

A tube member for a bagmaking and packaging device of a seventh aspect guides downward contents entering the tube member from above and allows a packaging material to become wrapped around it to thereby form the packaging material into a tubular shape. In the tube member is formed a cutout portion. The cutout portion is formed so that an inert gas can move between the inside space of the tube member and a space between the packaging material formed into the tubular shape and the tube member. The inert gas is a gas delivered into the packaging material formed into the tubular shape. The cutout portion extends in an up and down direction.

A tube member for a bagmaking and packaging device of an eighth aspect is the tube member of the seventh aspect, wherein the cutout portion extends upward from a lower end of the tube member.

A tube member for a bagmaking and packaging device of a ninth aspect is the tube member of the seventh aspect or eighth aspect, wherein a transverse section of the tube member at a height position of the part where the cutout portion is formed is substantially C-shaped.

According to the bagmaking and packaging device or the tube member for a bagmaking and packaging device pertaining to the present invention, the supply quantity of an inert gas can be reduced.

DETAILED DESCRIPTION

Figure 1:
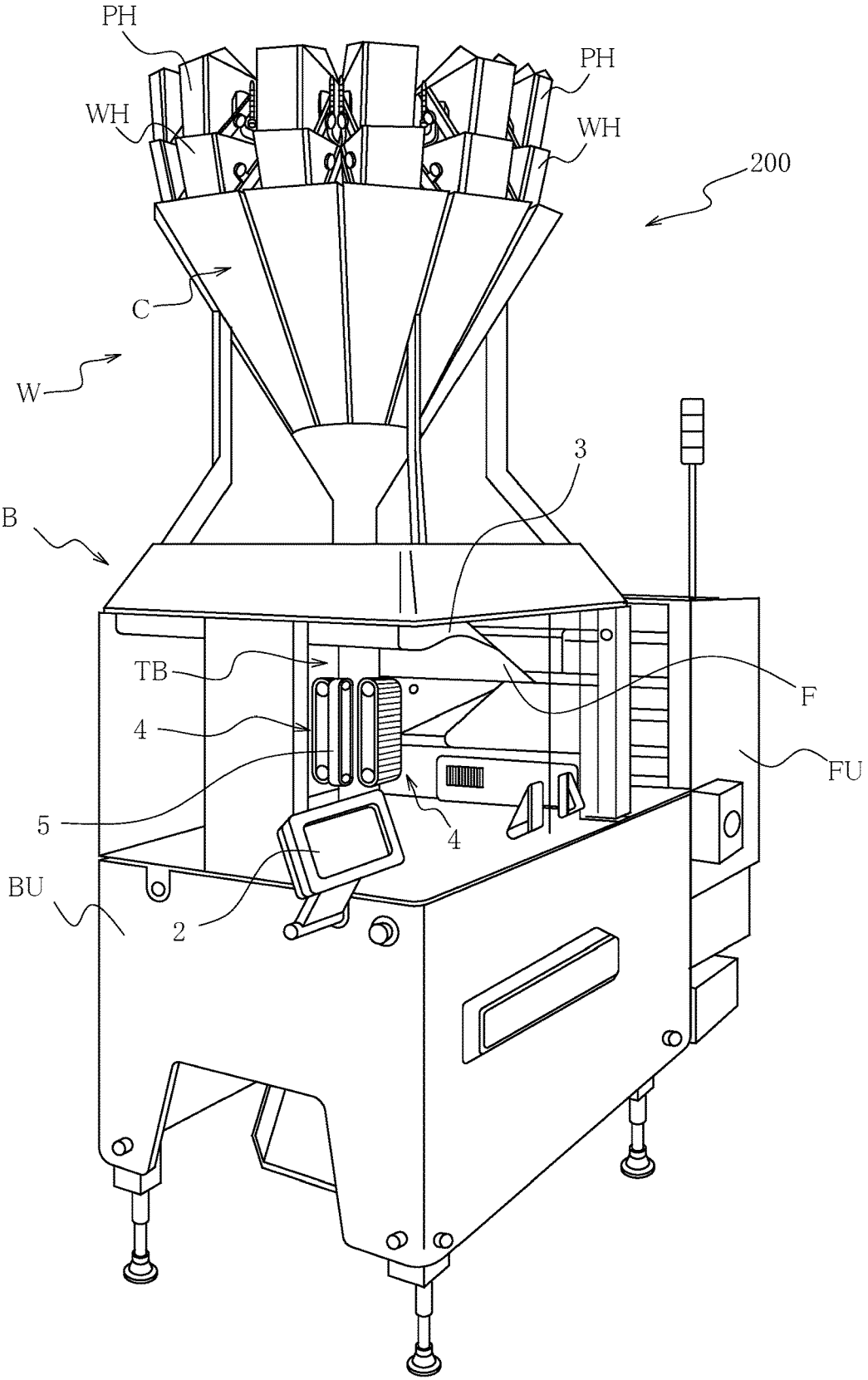
FIG. 1 is an external view of a weighing and packaging system in which a bagmaking and packaging device pertaining to an embodiment of the invention and a weighing device are integrated.

FIG. 1 shows a bagmaking and packaging device B pertaining to an embodiment of the invention and a weighing device W. The bagmaking and packaging device B and the weighing device W form an integrated weighing and packaging system 200, share a frame and legs, and are interconnectedly controlled. In the weighing and packaging system 200, the bagmaking and packaging device B is disposed below and the weighing device W is disposed above. The front side of the weighing and packaging system 200 is provided with a touch panel 2 with which the bagmaking and packaging device B and the weighing device W can be integrally operated.

(1) Weighing Device

The weighing device W is a combination weigher with a well-known configuration. Here, product M to be weighed is a snack food, such as potato chips, and is supplied to the central upper portion of the weighing device W. The supplied product M is dispersed to plural radial paths and thereafter is supplied, via plural pool hoppers PH disposed at the terminal ends of the paths, to corresponding weigh hoppers WH below the pool hoppers PH. The weights of the product M weighed by the weigh hoppers WH are combined and an optimum combination of weigh hoppers WH for forming a fixed weight of the product M is selected. The selected weigh hoppers WH discharge the product M to a collection chute C based on a discharge request signal from the bagmaking and packaging device B. The discharged product M is supplied from the collection chute C to the bagmaking and packaging device B.

(2) Bagmaking and Packaging Device

The bagmaking and packaging device B stores the product M (contents) discharged from the weighing device W in a tubular bag b (see FIG. 2) and thereafter simultaneously transversely seals the upper end portion of the bag b and the lower end portion of the following bag to thereby bag the product M. The bagmaking and packaging device B is configured by a packaging unit BU that manufactures bagged products from the tubular bags b, a packaging material supply unit FU that supplies a packaging material F to the packaging unit BU, and a control unit 10 (see FIG. 8) that controls the operation of drive units of the units BU and FU.

(2-1) Packaging Material Supply Unit

The packaging material supply unit FU supplies the sheet-like packaging material F to a former 3 (described later) of the packaging unit BU and is provided adjacent to the rear side of the packaging unit BU.

(2-2) Packaging Unit

Figure 2:
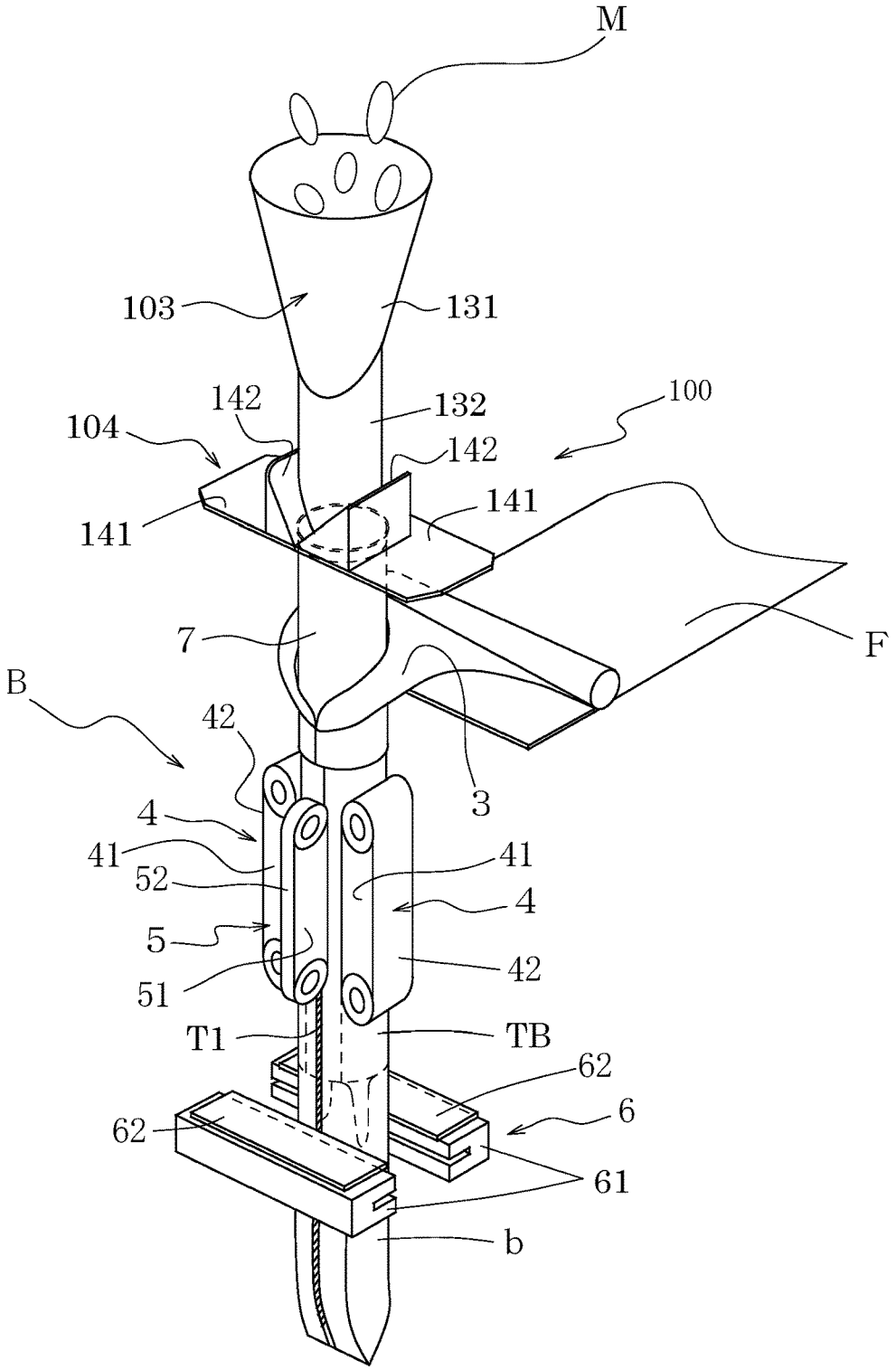
FIG. 2 is a schematic perspective view of a packaging unit and a filling unit of the bagmaking and packaging device.

As shown in FIG. 2, the packaging unit BU includes a former 3 that forms the sheet-like packaging material F into a tubular shape, pull-down belts 4 that convey downward the packaging material F formed into the tubular shape, a longitudinal sealing unit 5, and a transverse sealing unit 6. The longitudinal sealing unit 5 longitudinally seals, on the front side, a seam T1 that is the part where both width direction edges of the tubular packaging material F overlap each other. The transverse sealing unit 6 transversely seals the bag b formed in the lower end portion of the tubular packaging material F and simultaneously heat-seals the upper end portion of the bag b and the lower end portion of the following bag. The packaging unit BU also has a first tube member 7. The tubular packaging material F becomes wrapped around the outer periphery of the first tube member 7. The first tube member 7 guides, into the bag b, the product M dropping through its inside space. In the following description, the packaging material F formed into the tubular shape and the bag b formed in the lower end portion thereof are sometimes jointly called a tubular bag TB.

The packaging unit BU further includes a filling unit 100. The filling unit 100 receives, in a funnel-shaped chute 103, the product M dropping from the weighing device W disposed above and releases it via the first tube member 7 into the tubular bag TB. The packaging unit BU further has a gas supply unit 9 and an air supply unit 190 (described later). The gas supply unit 9 fills the tubular bag TB and the first tube member 7 with an inert gas. As the inert gas, nitrogen and argon gas can be used. Here, nitrogen is used as the inert gas. The air supply unit 190 delivers air from above into the first tube member 7.

(2-2-1) Former

Figure 3:
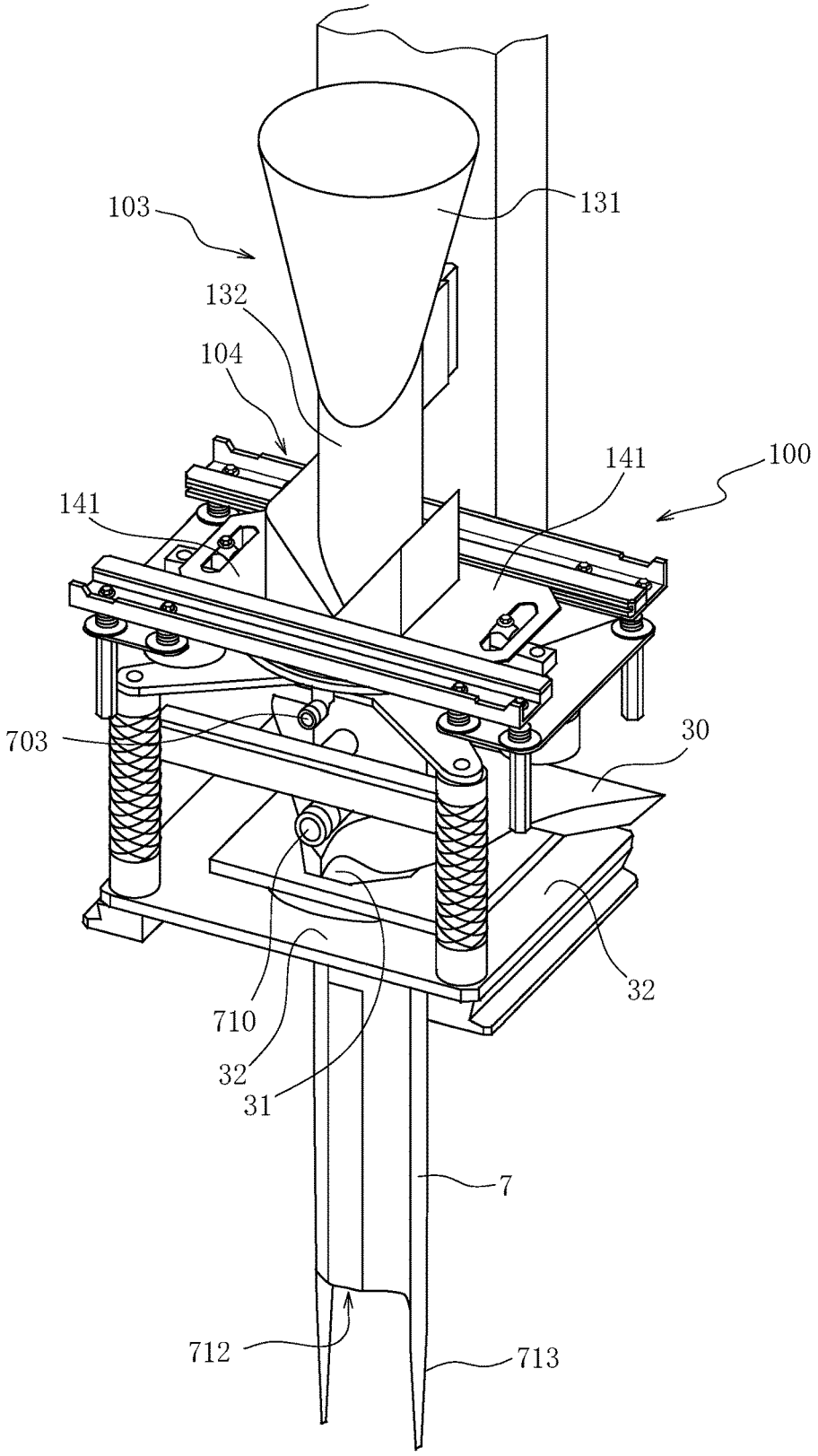
FIG. 3 is a perspective view of the filling unit, a former, and a first tube member of the bagmaking and packaging device.

As shown in FIG. 3, the former 3 includes a sailor collar portion 30 that bends the sheet-like packaging material F into the tubular shape and a collar part 31 formed around the first tube member 7. The former 3 and the first tube member 7, which runs vertically through the collar part 31, are attached to a base member 32. The collar part 31 of the sailor collar portion 30 is formed in a cylindrical shape so as to surround the outer periphery of the first tube member 7 and meets on its front side like a kimono collar leaving a slight gap. When setting the packaging material F, the packaging material F is placed along the surface of the sailor collar portion 30 and bent, and then it is bent into the tubular shape at the collar part 31, passed through a gap between the inside of the collar part 31 and the outside of the tube member 7, and wrapped around the outer periphery of the first tube member 7.

(2-2-2) First Tube Member

The first tube member 7 is disposed above the transverse sealing unit 6 and extends in an up and down direction. The first tube member 7 allows the packaging material F to become wrapped around it to thereby form the packaging material F into the tubular shape and guides downward the product M entering the first tube member 7 from above. The lower end portion of the first tube member 7 is provided with a spreader 713 that spreads the tubular bag TB from inside.

Figure 4:
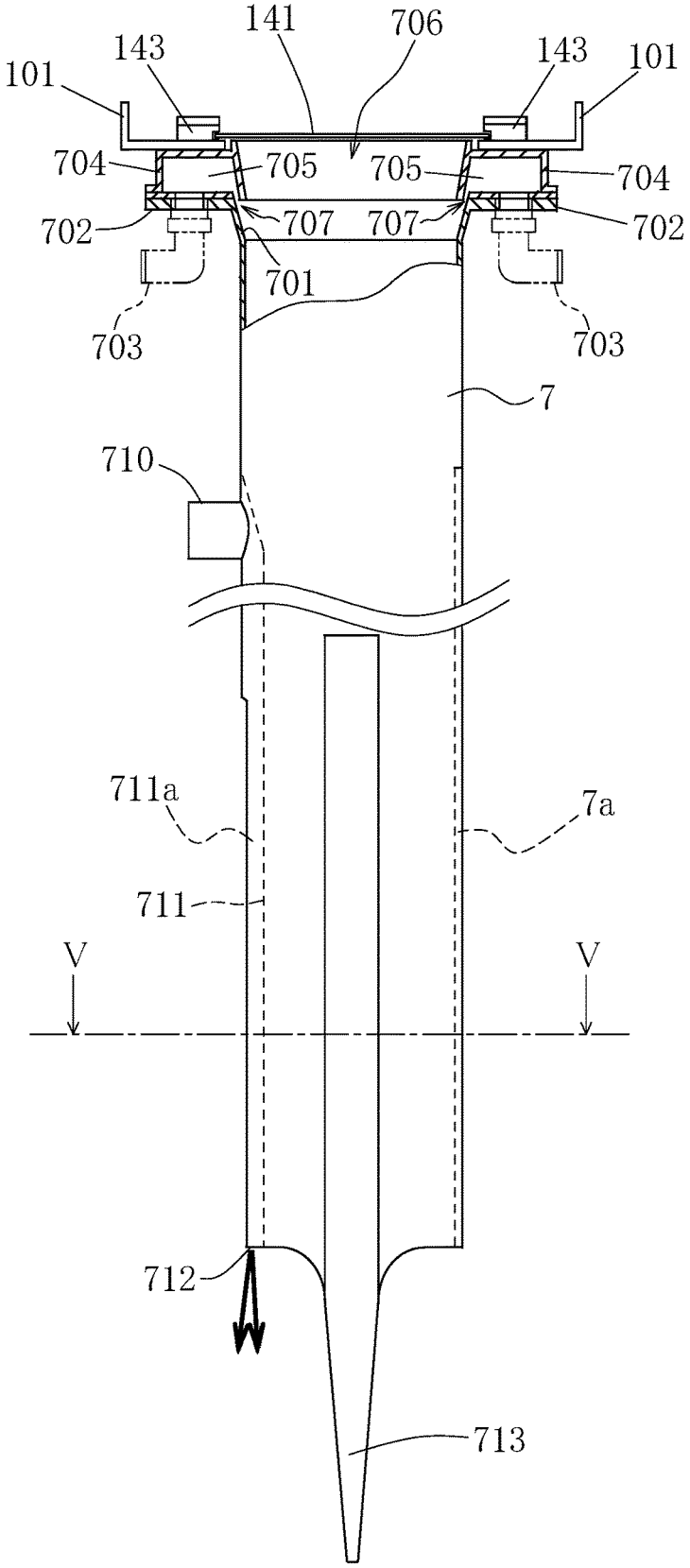
FIG. 4 is a partial sectional view of the first tube member and a structure around the upper portion of the first tube member.
Figure 5:
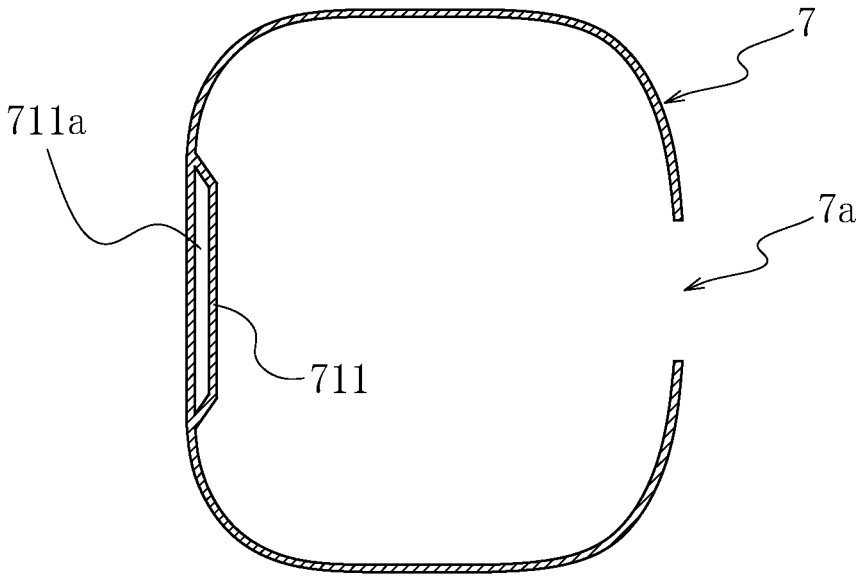
FIG. 5 is a sectional view seen from the direction of the arrows associated with line V-V of FIG. 4.

As shown in FIG. 5, in the rear side of the first tube member 7 is formed a slot-shaped cutout portion 7*a* that extends in the up and down direction, as indicated in FIG. 4. The cutout portion 7*a* is slot-shaped in that it is much longer than it is wide, as illustrated in FIGS. 4 and 5, in particular. Given the relatively narrow width of the cutout portion 7*a*, and given the overall tubular shape of the tube member 7, the cutout portion 7*a* gives the tube member 7 a transverse section—at locations where the slot is formed—a closed C-shaped configuration, i.e., a configuration with exposed terminal edges of the walls of the tube member 7 on either side of the slot-shaped cutout portion 7*a* facing each other. (This is in contrast to a more open, U-shaped configuration, with "arms" of the U being parallel to each other.) Additionally, as illustrated in FIGS. 4 and 5, the width of the slot-shaped cutout portion 7*a* (i.e., a distance between the terminal edges of the walls of the tube member 7 which face each other) is substantially constant along the entire length of the slot-shaped cutout portion 7*a*. As shown in FIG. 4, the cutout portion 7*a* extends upward from the lower end of the first tube member 7. As described later, the cutout portion 7*a* allows the inert gas to move between the space of a gap between the packaging material F formed into the tubular shape and the first tube member 7 and the inside space of the first tube member 7. The height position of the upper end of the cutout portion 7*a* is a height position a little lower than the sailor collar portion 30. As shown in FIG. 5, a transverse section of the first tube member 7 at a height position of the part where the cutout portion 7*a* is formed is substantially C-shaped.

(2-2-3) Flange

FIG. 4 shows a partial sectional view of the first tube member 7. In the upper portion of the first tube member 7 is formed a funnel-shaped inclined portion 701, and a flange 702 is attached to the upper end edge of the inclined portion 701. Through holes are vertically provided in two opposing places of the flange 702 (the front and rear of the flange 702), and one-touch connectors 703 for injecting air are attached to the through holes. The air is supplied via hoses from a later-described high-pressure air supply system 191 (see FIG. 7).

A hollow donut-shaped cap 704 whose bottom surface is open covers the flange 702 with a seal therebetween, and an air passage 705 is formed by the cap 704 and the flange 702. In the central portion of the donut-shaped cap 704 is formed a funnel-shaped upper end open portion 706, and a ring-shaped downward inclined slit formed between the inner wall of the upper end open portion 706 and the inclined portion 701 serves as an air outlet 707.

On the upper surface of the cap 704 is placed a base frame 101 of the filling unit 100, and the cap 704 and the base frame 101 are coupled to each other by couplings not shown in the drawings.

(2-2-4) Socket and Gas Flow Path Member

As shown in FIG. 3, a socket 710 for injecting the inert gas (nitrogen) into the first tube member 7 is attached to the front side of the first tube member 7 separately from the one-touch connectors 703, and a one-touch connector not shown in the drawings is attached to the socket 710.

Furthermore, a gas flow path member 711 that guides to the lower end portion of the first tube member 7 the inert gas (nitrogen) injected from the socket 710 is welded to the inner wall of the first tube member 7 connected to the socket 710. A gas flow path 711*a* that is a flow path for the inert gas is formed by the inner wall of the first tube member 7 and the gas flow path member 711 (see FIG. 5). The nitrogen is forcefully jetted into the tubular bag TB from a discharge outlet 712 (see FIG. 4) that is an opening in the lower end of the gas flow path 711*a*. Because of this, oxygen in the tubular bag TB is replaced with the nitrogen.

(2-2-5) Pull-Down Belts

The pull-down belts 4, 4 are disposed on both sides of the first tube member 7 and have suction chambers 41, 41 and perforated belts 42, 42 that travel inwardly of each other around the suction chambers 41, 41. The pull-down belts 4, 4 suck hold of with the belts 42, 42 and simultaneously convey downward the tubular bag TB (see FIG. 2).

(2-2-6) Longitudinal Sealing Unit

The longitudinal sealing unit 5 presses the seam T1 of the packaging material F formed into the tubular shape against the first tube member 7 with a constant pressure and simultaneously heat-seals the seam T1. The longitudinal sealing unit 5 has a heater block 51 and a metal belt 52 that travels around the heater block 51 synchronously with the packaging material F (see FIG. 2).

(2-2-7) Transverse Sealing Unit

The transverse sealing unit 6, which transversely seals the packaging material F formed into the tubular shape (the tubular bag TB), has a pair of sealing jaws 61, 61 with built-in heaters and drive mechanisms (not shown in the drawings) that cause the pair of sealing jaws 61, 61 to move toward and away from the tubular bag TB. Clam shutters 62, 62 that pinch the tubular bag TB from front and back are attached to the upper portions of the sealing jaws 61, 61 so as to be movable forward and backward in the horizontal direction. The clam shutters 62, 62 intercept fine powder of the dropping product M before the sealing jaws 61, 61, thereby preventing the falling fine powder from getting trapped in the transverse seal portion of the bag b.

As the drive mechanisms of the transverse sealing unit 6, for example, the mechanism disclosed in JP-A No. H10-53206 can be used. The drive mechanisms cause the pair of sealing jaws 61, 61 to revolve inwardly of each other while simultaneously causing each of the sealing jaws 61, 61 to follow a D-shaped trajectory of motion (D motion). Alternatively, the drive mechanisms may cause each of the sealing jaws 61, 61 to carry out a box motion.

The sealing jaws 61, 61 pinch the tubular bag TB and press against each other to thereby simultaneously transversely seal the upper portion of the bag b on the lower end portion of the tubular bag TB and the lower portion of the following bag TB. Furthermore, one of the sealing jaws 61 has a built-in cutter not shown in the drawings, and the cutter is activated to vertically separate the bag b on the lower end portion from the following bag TB.

(2-2-8) Filling Unit

The filling unit 100 is disposed above the former 3 and the first tube member 7. The filling unit 100 is a device that successively drops the product M at a predetermined timing to the tubular bag TB. The filling unit 100 mainly has the chute 103 and a gate 104.

The chute 103 is formed by a funnel portion 131 above and a second tube member 132 below. The lower end of the funnel portion 131 and the upper end of the second tube member 132 are vertically connected to each other via diagonally cut oval open portions. The outer diameter of the second tube member 132 is smaller than the inner diameter of the first tube member 7. A discharge outlet in the lower end of the second tube member 132 is cut in a V-shape. The cut surface is opened and closed by the gate 104 from both sides.

The gate 104 has opening/closing plates 141, 141 that open and close the opening in the upper end of the first tube member 7 and inclined plates 142, 142 that extend diagonally rearward from butting portions of the opening/closing plates 141, 141. The inclined plates 142, 142 are configured to open and close, from both sides, the discharge outlet in the lower end of the second tube member 132 cut in a V-shape. The plates 141 and 142 are configured to be moved toward and away from each other in the direction of the black arrows shown in FIG. 10A (the right and left direction in FIG. 10A) by an opening/closing mechanism not shown in the drawings. The plates 141 and 142 of the gate 104 move along a pair of guide rails 143, 143 that extend in the horizontal direction (see FIG. 4). The opening in the upper end of the first tube member 7 and the discharge outlet in the lower end of the second tube member 132 are simultaneously opened and closed by the opening and closing motion of the plates 141 and 142 of the gate 104.

The opening/closing plates 141, 141 that open and close the opening in the upper end of the first tube member 7 become necessary when air is blown into the first tube member 7, and can be omitted when this blowing of air is not performed. Furthermore, the lower end portion of the second tube member 132 may also be diagonally cut rather than cut in a V-shape, so that an inclined gate is formed by just one inclined plate 142.

Figure 9A:
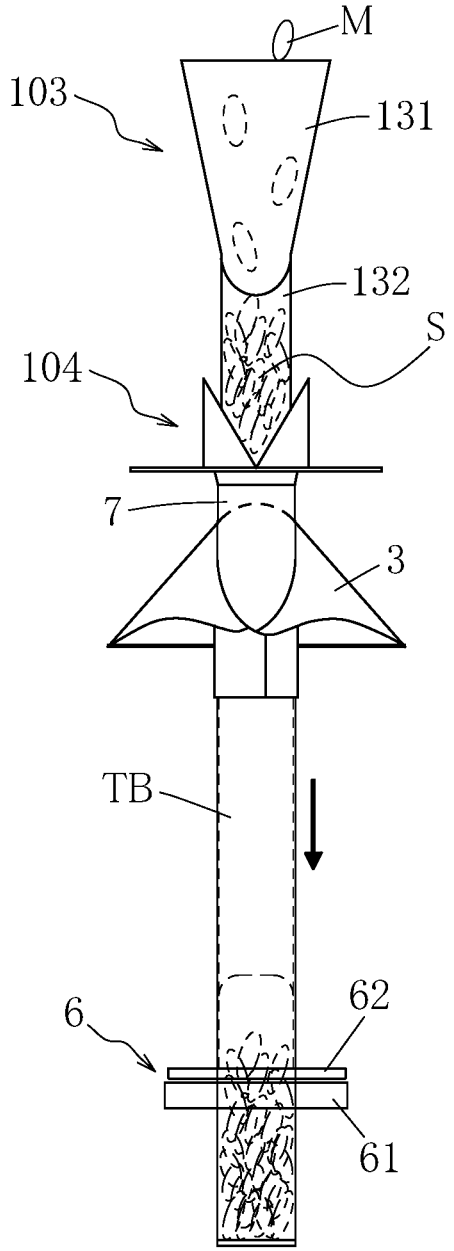
FIG. 9A is a schematic front view showing a state in which product is being retained in a retention space in the bagmaking and packaging device.
Figure 9B:
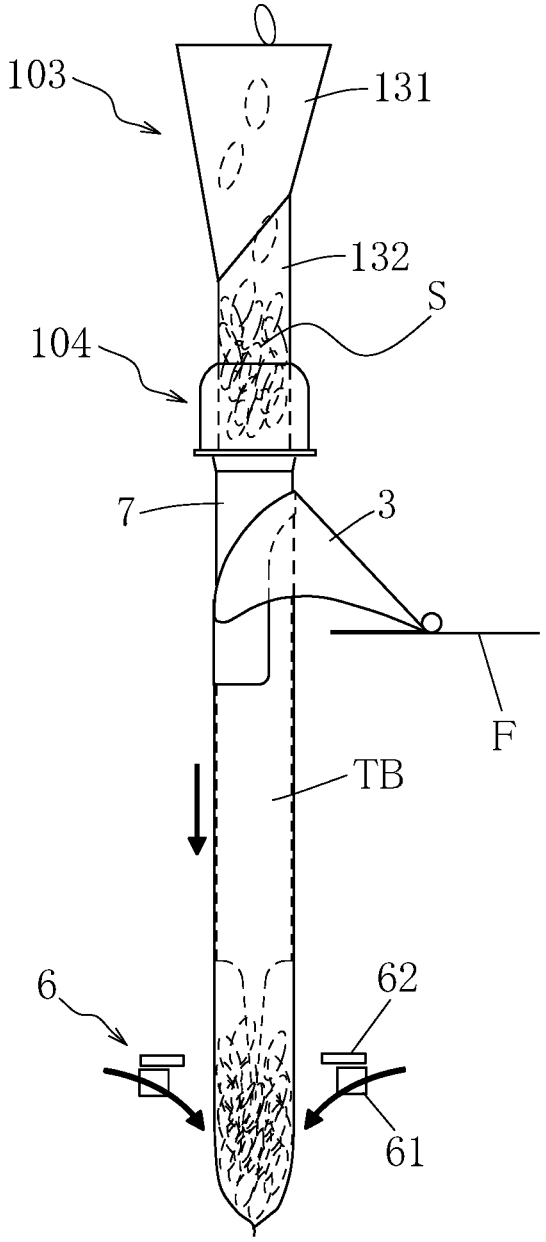
FIG. 9B is a schematic side view showing the state in which the product is being retained in the retention space in the bagmaking and packaging device.
Figure 10A:
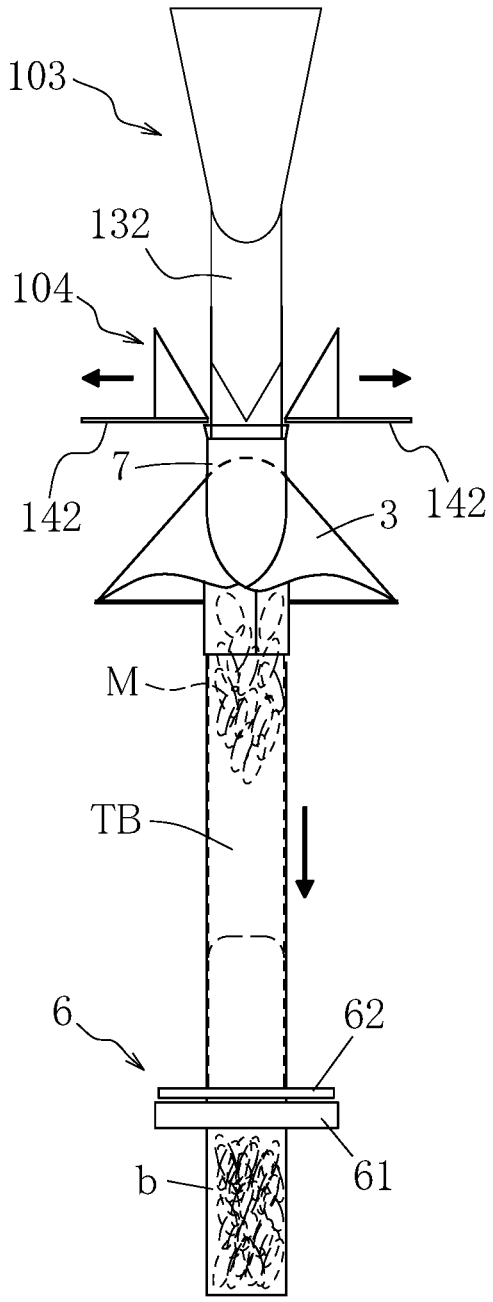
FIG. 10A is a schematic front view showing a state in which the retention space in the bagmaking and packaging device has been eliminated.
Figure 10B:
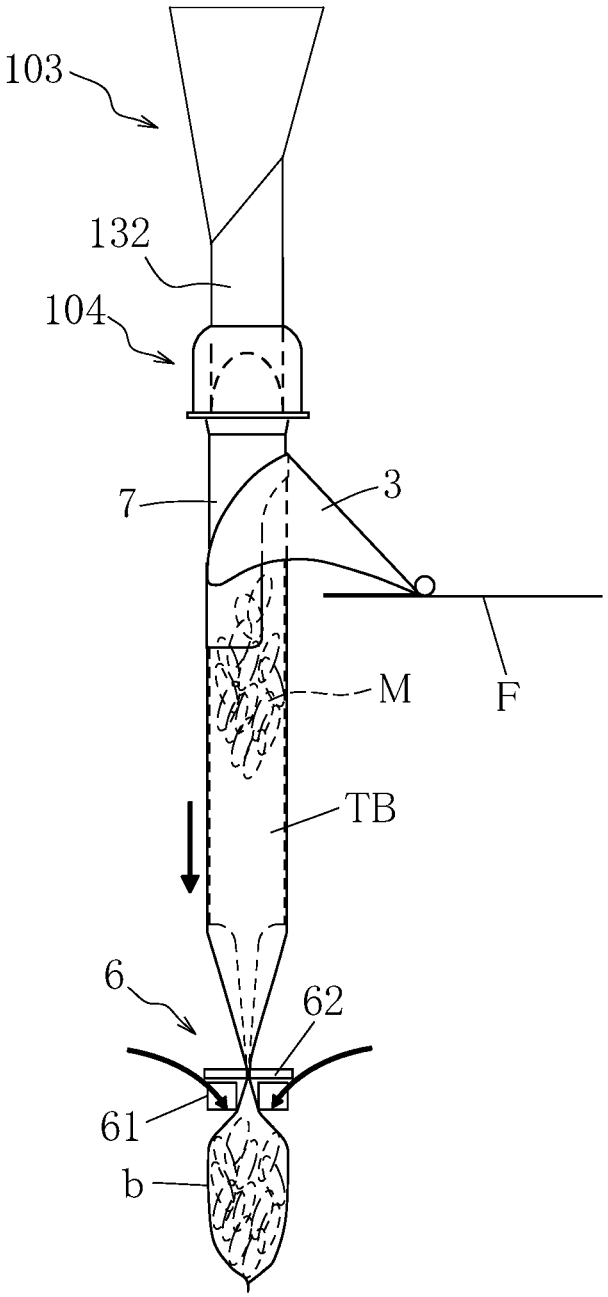
FIG. 10B is a schematic side view showing the state in which the retention space in the bagmaking and packaging device has been eliminated.

FIG. 9A, FIG. 9B, FIG. 10A, and FIG. 10B show the actions of the filling unit 100. Referring now to these drawings, the product M dropping to the filling unit 100 from the weighing device W above is deflected to a vertical posture and fills the inside of the second tube member 132 when it slides down through the chute 103. The state shown in FIG. 9A and FIG. 9B is a state in which the gate 104 is closed so that a retention space S for temporarily retaining the product M is formed by the second tube member 132 and the gate 104. The state shown in FIG. 10A and FIG. 10B is a state in which the gate 104 is opened so that the retention space S is eliminated. Hereinafter, the state shown in FIG. 9A and FIG. 9B will be called a "gate closed" state, and the state shown in FIG. 10A and FIG. 10B will be called a "gate open" state.

(2-2-9) Gas Supply Unit

Figure 6:
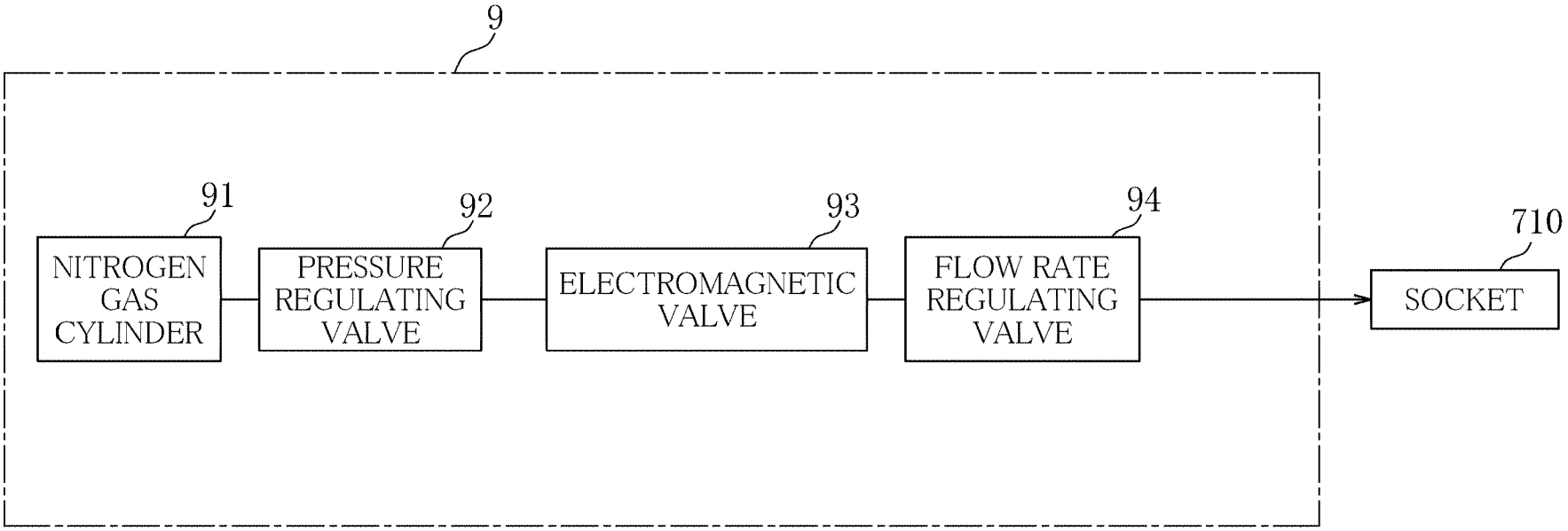
FIG. 6 is a block diagram showing the configuration of a gas supply unit.

As shown in FIG. 6, the gas supply unit 9 is configured by a nitrogen gas cylinder 91 that stores nitrogen in a pressurized state, a pressure regulating valve 92 that depressurizes and delivers the nitrogen supplied from the nitrogen gas cylinder 91, and an electromagnetic valve 93 and a flow rate regulating valve 94 that are connected to a flow path extending from the pressure regulating valve 92.

The outlet side of the flow rate regulating valve 94 is connected via a connector to the socket 710 attached to the first tube member 7. When the electromagnetic valve 93 is opened, the nitrogen flows to the gas flow path 711*a* that is inside the first tube member 7, and the nitrogen is jetted downward from the discharge outlet 712 in the lower end of the gas flow path 711*a* into the tubular bag TB (see FIG. 4). The flow rate of the nitrogen is set to a flow rate needed to replace the gas inside the tubular bag TB in a short amount of time. The flow rate of the nitrogen is set to different values depending on the bulk density of the product M, the net content, the bag size, and the operating speed, for example.

(2-2-10) Air Supply Unit

Figure 7:
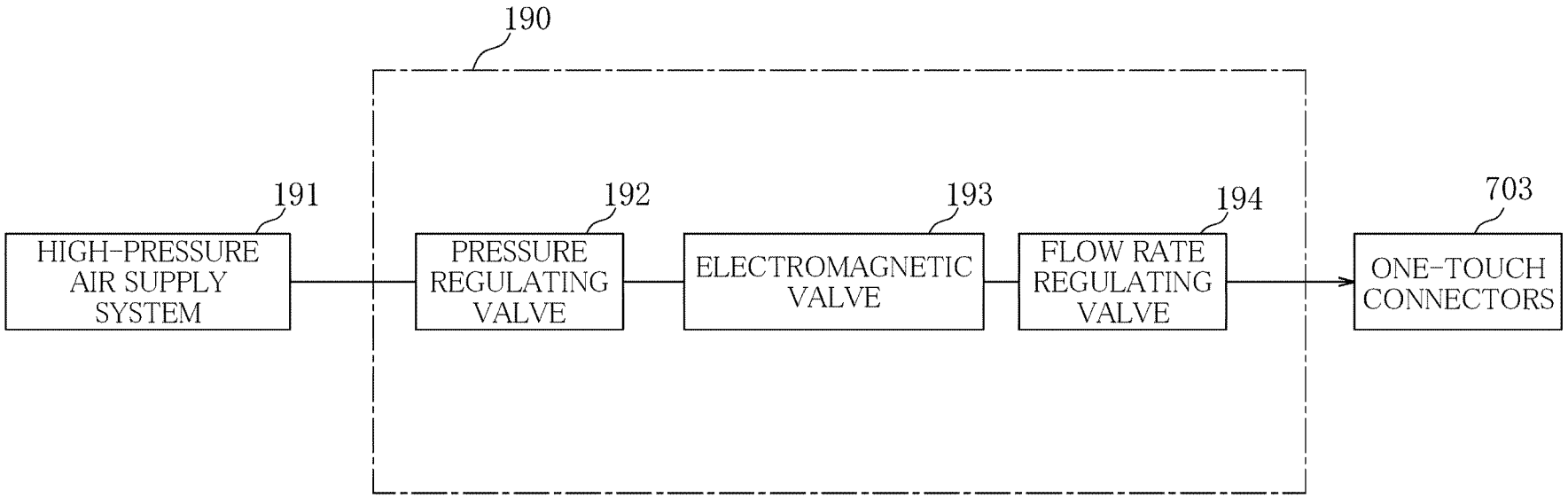
FIG. 7 is a block diagram showing the configuration of an air supply unit.

As shown in FIG. 7, the air supply unit 190 receives a supply of air from a high-pressure air supply system 191 in a factory where the weighing and packaging system 200 is installed, depressurizes the air, regulates the flow rate of the air, and supplies the air from above into the first tube member 7. The air supply unit 190 is configured by a pressure regulating valve 192, which depressurizes and delivers the air supplied from the high-pressure air supply system 191, and an electromagnetic valve 193 and a flow rate regulating valve 194, which are connected to a flow path extending from the pressure regulating valve 192.

The outlet side of the flow rate regulating valve 194 is connected to the one-touch connectors 703. When the electromagnetic valve 193 is opened, the air flows to the air passage 705 positioned above the first tube member 7 and is blown out diagonally downward from the air outlet 707 (see FIG. 4). The air flows downward through the inside space of the first tube member 7. The quantity of the air supplied is set to different values depending on the bulk density of the product M, the net content, the bag size, and the operating speed, for example.

(2-3) Control Unit

Figure 8:
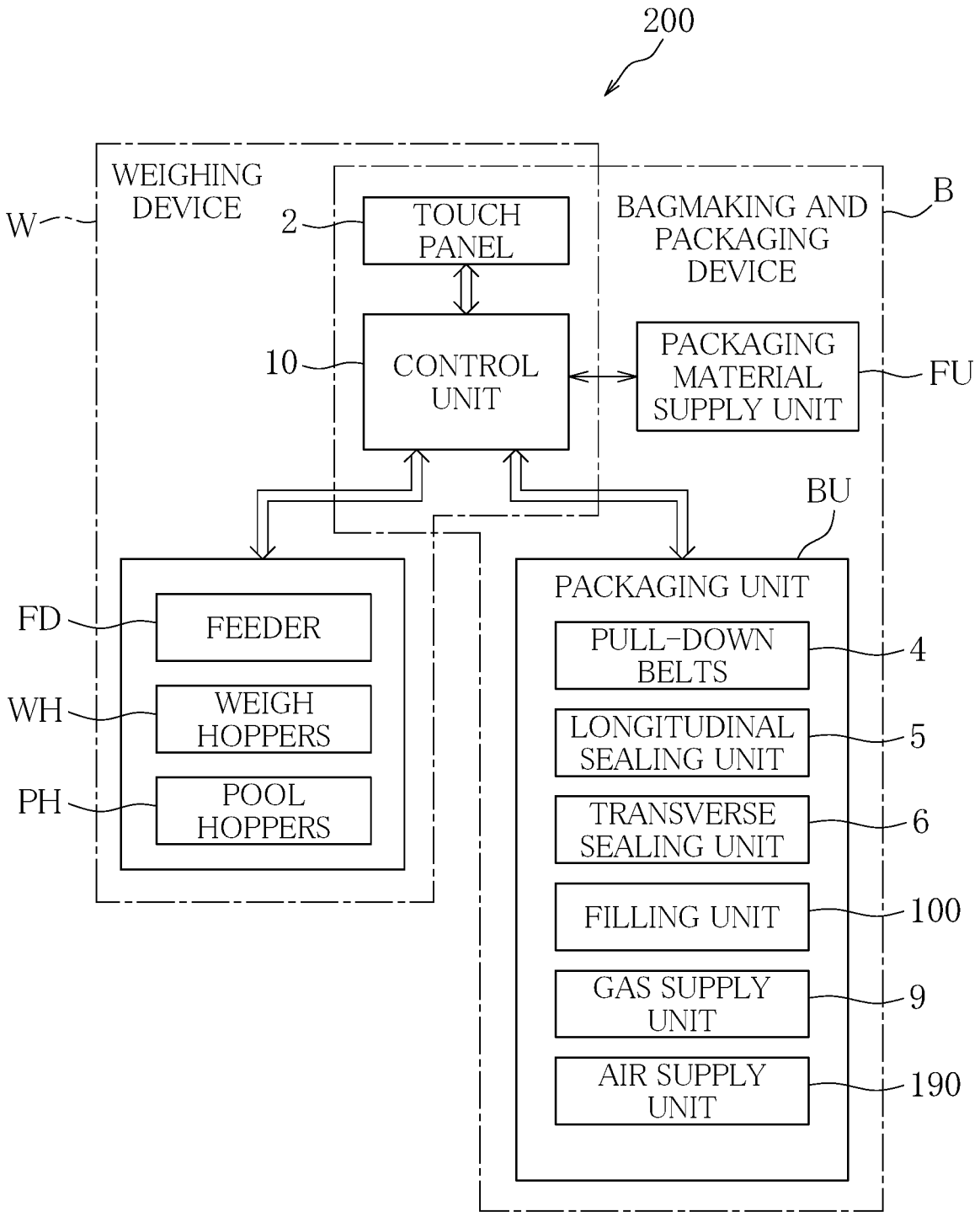
FIG. 8 is a control block diagram of the weighing and packaging system.

FIG. 8 is a control block diagram of the weighing and packaging system 200. The control unit 10 individually or integrally controls the weighing device W and the bagmaking and packaging device B, and is realized by a computer. The control unit 10 has a control processing device and a storage device. For the control processing device, a processor such as a CPU or a GPU can be used. The control processing device reads a program stored in the storage device and performs predetermined image processing and arithmetic processing in accordance with the program. Moreover, the control processing device can write the arithmetic results in the storage device and read information stored in the storage device in accordance with the program.

The control unit 10 controls the drive units of the packaging unit BU and the packaging material supply unit FU in accordance with parameters and operating conditions set using the touch panel 2 shown in FIG. 1. The control unit 10 also controls a feeder FD, the pool hoppers PH, and the weigh hoppers WH of the weighing device W. The control unit 10 also imports necessary information from various sensors installed in the weighing device W and the bagmaking and packaging device B and performs various types of control based on the information.

With respect to the packaging unit BU, the control unit 10 controls the pull-down belts 4, the longitudinal sealing unit 5, the transverse sealing unit 6, the filling unit 100, the gas supply unit 9, and the air supply unit 190. The control unit 10 controls these in association with each other.

(3) Actions of Weighing and Packaging System 200

Below, the actions of the weighing device W and the bagmaking and packaging device B will be described. Description of well-known actions will be simplified or omitted, and actions pertaining to the present invention will be mainly described.

(3-1) Actions Before Commencement of Operation

First, as advance preparation, in the bagmaking and packaging device B an operator sets the packaging material F in the former 3 and forms it into the tubular shape. Meanwhile, in the weighing device W, the product M is supplied to the central upper portion of the weighing device W. Then, when the operator operates the touch panel 2 and instructs the commencement of operation, the control unit 10 first activates the pull-down belts 4, the longitudinal sealing unit 5, and the transverse sealing unit 6 to form the tubular bag TB. When this is done, the control unit 10 carries out nitrogen replacement before commencement of operation, which is called flushing.

Figure 12A:
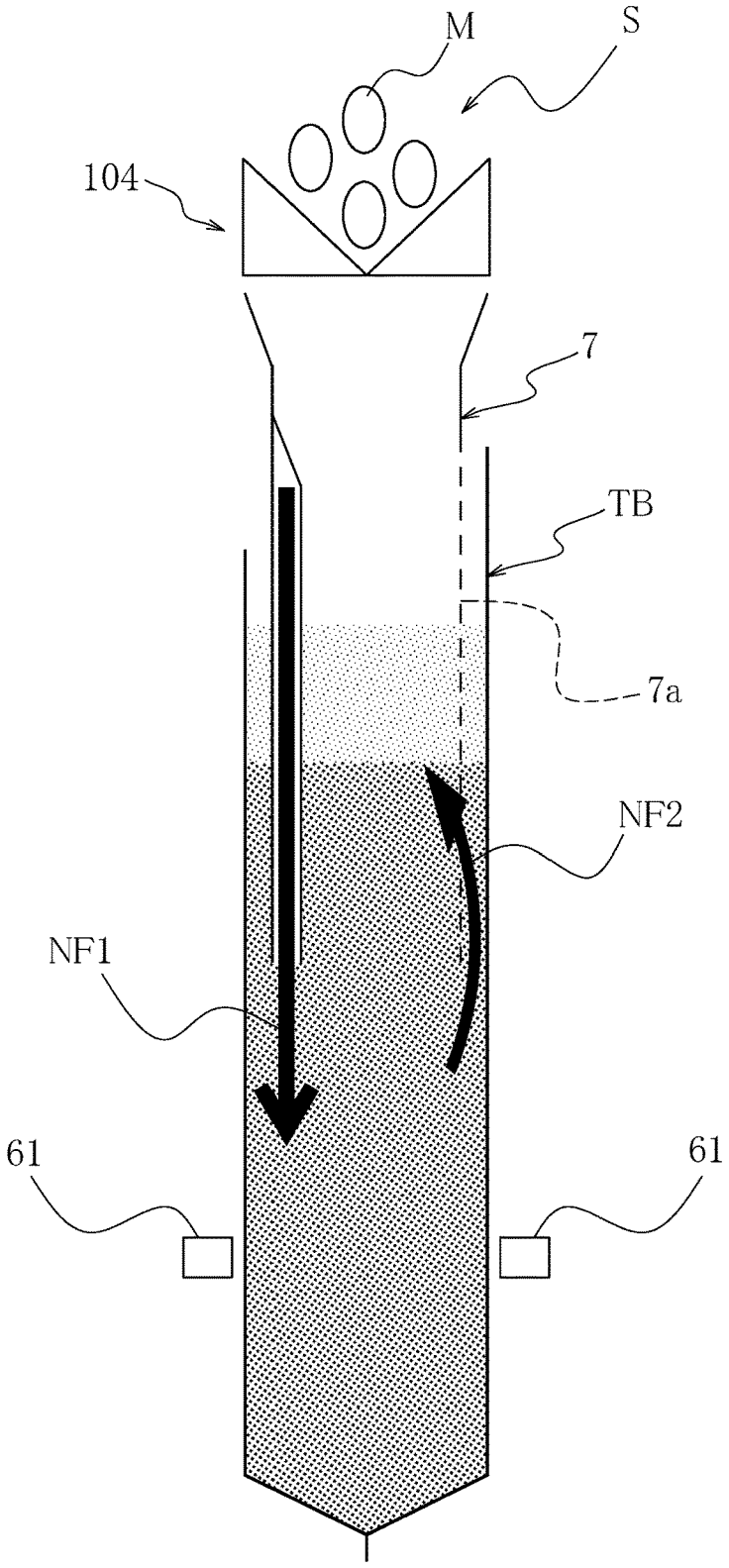
FIG. 12A is a drawing showing the jetting and flow of nitrogen during bagmaking and packaging actions.

FIG. 12A shows the flushing that is an initial nitrogen replacement action. In the bagmaking and packaging device B, the control unit 10 opens the electromagnetic valve 93 of the gas supply unit 9 to flow the nitrogen to the gas flow path 711*a* that is inside the first tube member 7. The nitrogen jetted downward into the tubular bag TB from the discharge outlet 712 in the lower end of the gas flow path 711*a* (see arrow NF1 in FIG. 12A) first replaces the air that is in the lower portion of the inside space of the bag TB and thereafter flows upward so that the air is pushed out from below. At this time, because the cutout portion 7*a* is formed in the rear side of the first tube member 7, the nitrogen rising along the part on the rear side of the inner surface of the bag TB flows en route to the space inside the first tube member 7 (see arrow NF2 in FIG. 12A). In other words, the quantity of the nitrogen that ends up escaping directly upward from the space of the gap between the inner surface of the bag TB and the first tube member 7 becomes less.

Meanwhile, in the weighing device W, as the flushing is taking place, the product M is supplied from the pool hoppers PH to the weigh hoppers WH, and combination weighing is performed. When discharge preparations are finished, the control unit 10 closes the gate 104 and sends a start signal to the weighing device W to discharge an initial batch of the product M pertaining to the optimum combination from the weighing device W.

Figure 12B:
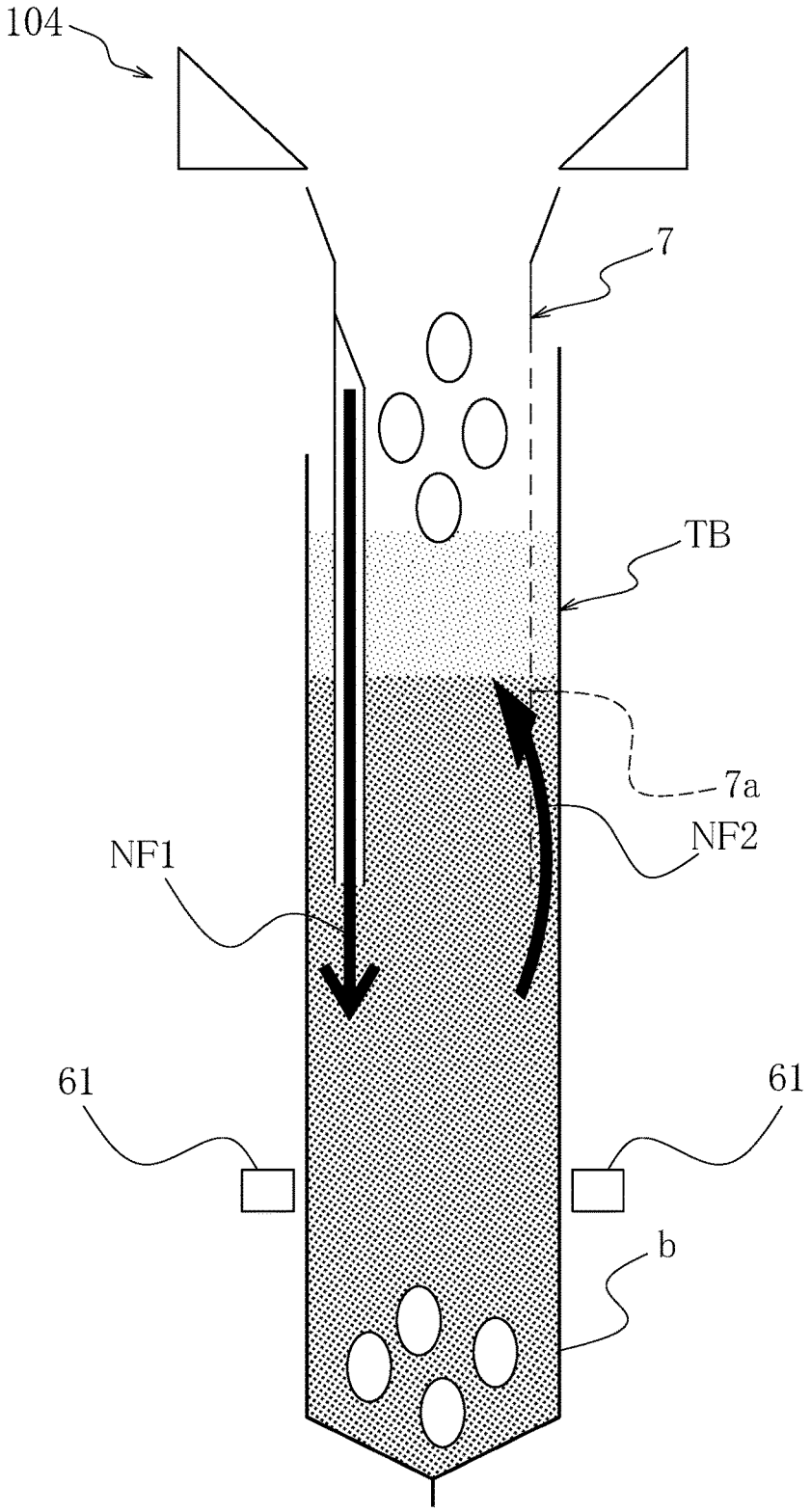
FIG. 12B is a drawing showing the jetting and flow of nitrogen during bagmaking and packaging actions.

(3-2) Actions when Operation Commences and Actions Repeated after Operation has Commenced When the flushing of a predetermined duration ends, the control unit 10 opens the gate 104 and commences normal operation as shown in FIG. 12B. At this time, the control unit 10 commences operation with a lower nitrogen supply quantity than during the flushing.

Figure 13A:
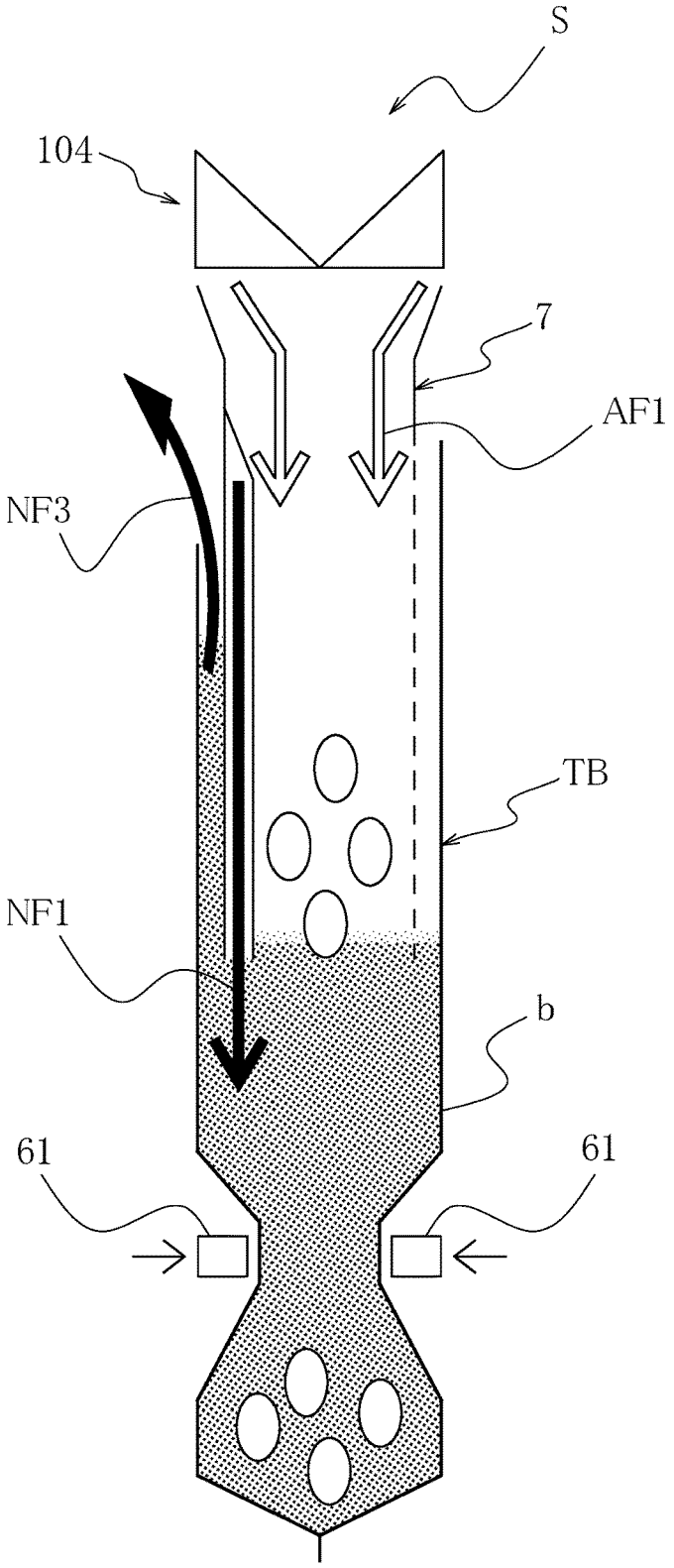
FIG. 13A is a drawing showing the jetting and flow of nitrogen and air during bagmaking and packaging actions.
Figure 13B:
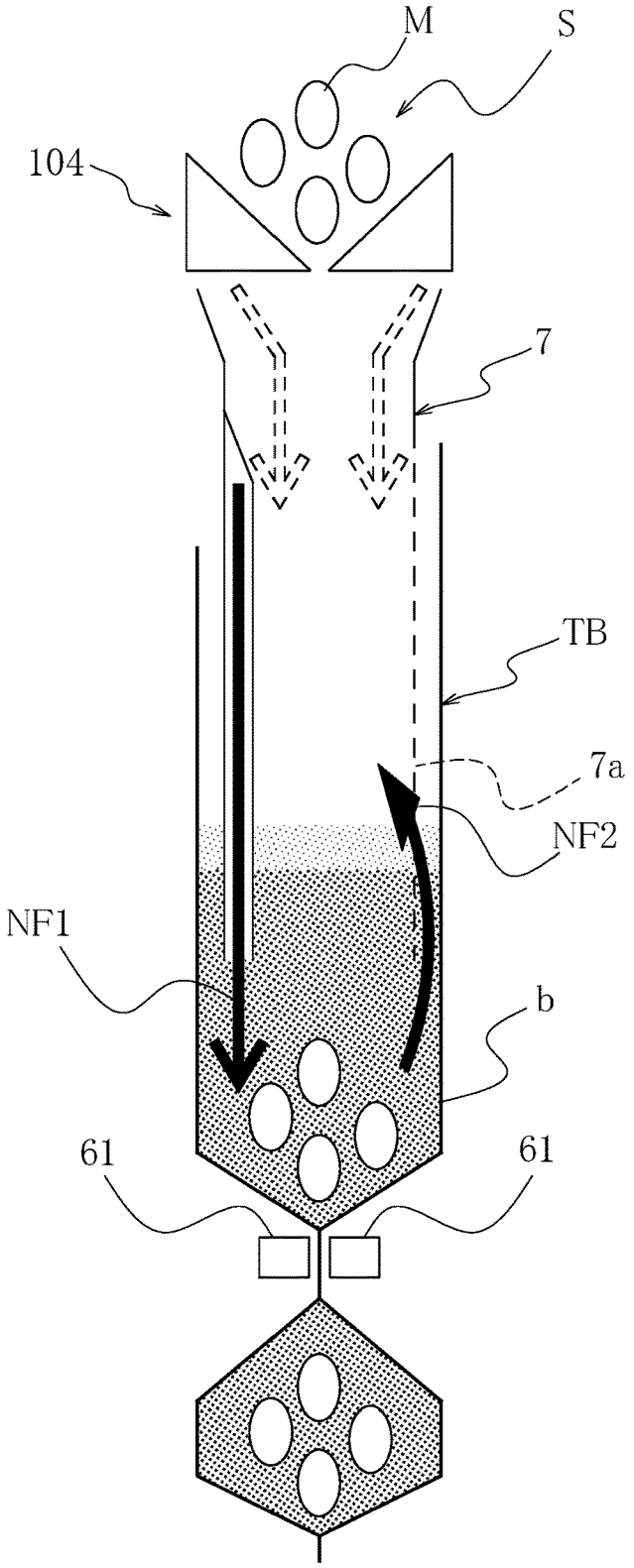
FIG. 13B is a drawing showing the jetting and flow of nitrogen during bagmaking and packaging actions.
Figure 13C:
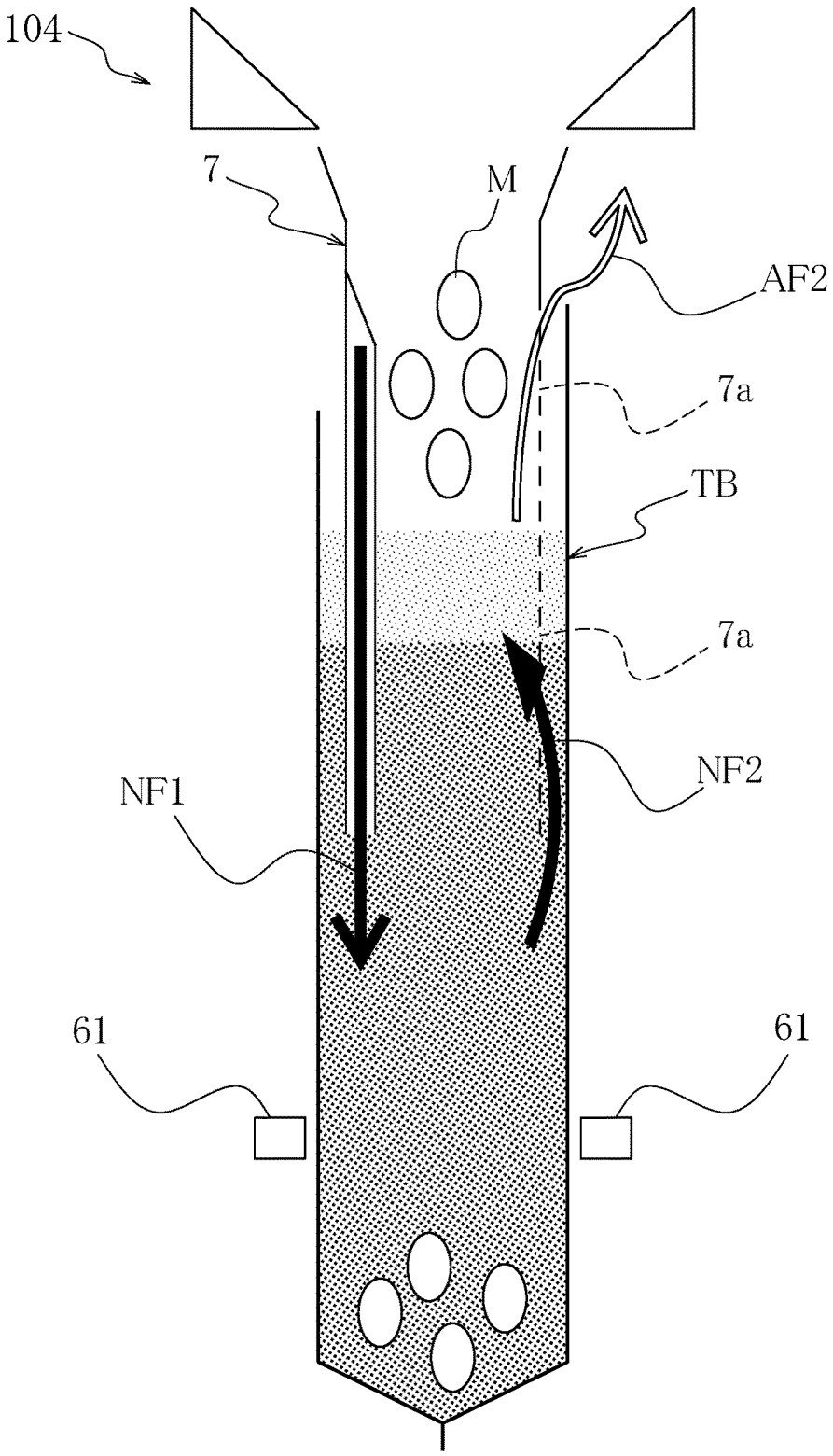
FIG. 13C is a drawing showing the jetting and flow of nitrogen and the flow of air during bagmaking and packaging actions.
Figure 14A:
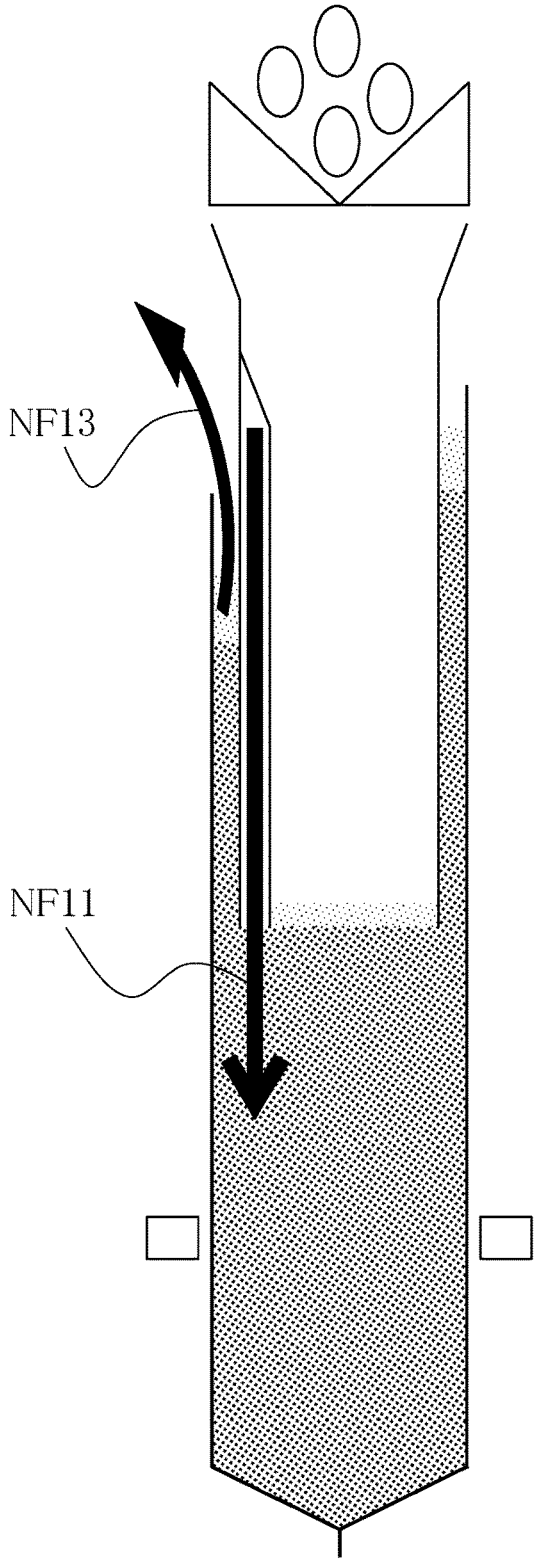
F I G. 14A(PRIOR ART)
FIG. 14A is a drawing showing the jetting and flow of nitrogen during bagmaking and packaging actions in a conventional bagmaking and packaging device.
Figure 14B:
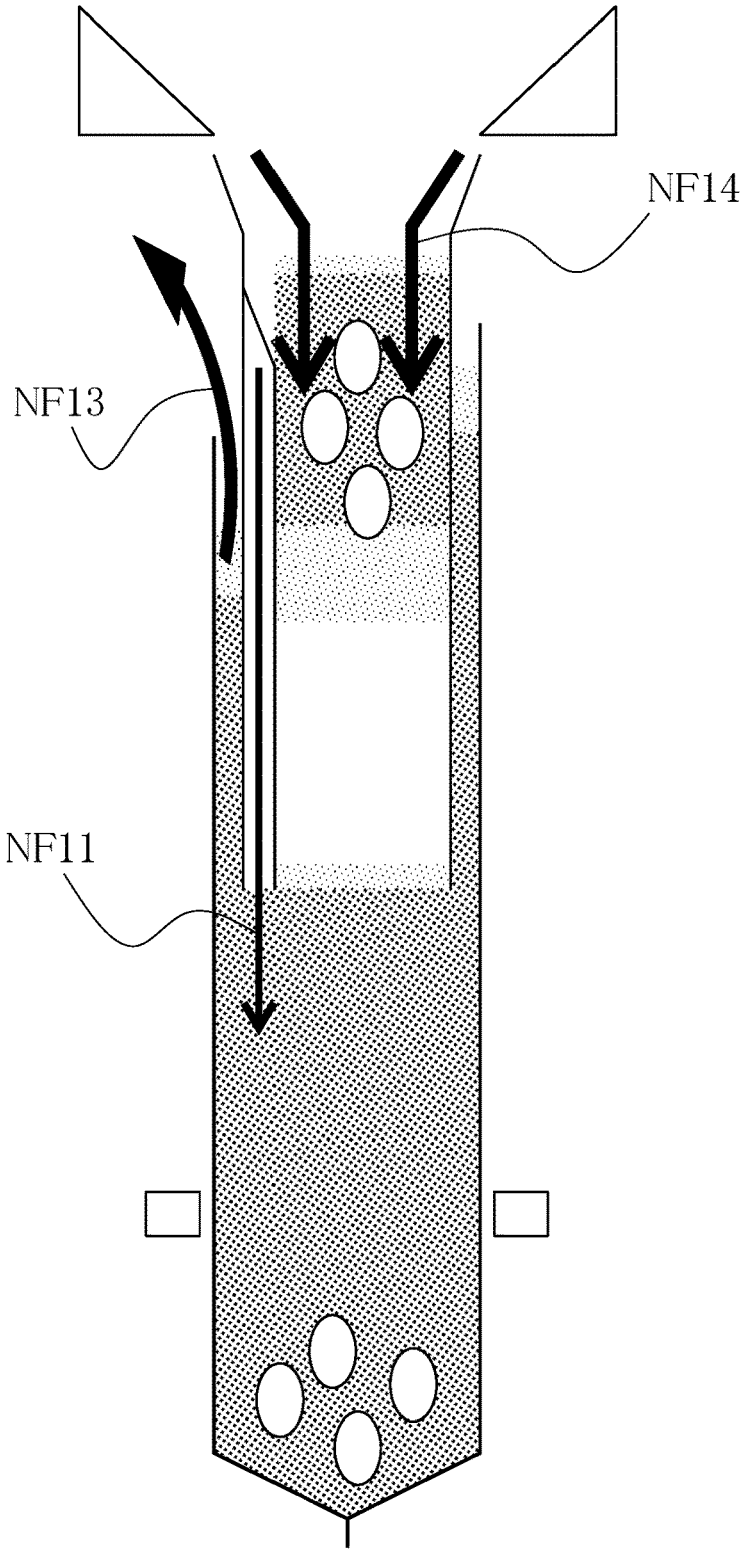
F I G. 14B(PRIOR ART)
FIG. 14B is a drawing showing the jetting and flow of nitrogen during bagmaking and packaging actions in the conventional bagmaking and packaging device.

When operation commences, the control unit 10 opens the gate 104, drops the initial batch of the product M to the bag b under the sealing jaws 61, 61, and then recloses the gate 104. Then, by opening the gate 104, the control unit 10 causes the next batch of the product M temporarily retained on the gate 104 to drop to the inside space of the tubular packaging material F (see FIG. 12B). Next, as shown in FIG. 13A, the control unit 10 closes the gate 104 and opens the electromagnetic valve 193 of the air supply unit 190 to deliver air from above into the first tube member 7 (see arrows AF1 in FIG. 13A). Then, at the stage when the batch of the product M dropping through the first tube member 7 is almost contained in the bag b above the transverse sealing unit 6, the pair of transverse sealing jaws 61, 61 of the transverse sealing unit 6 move toward the tubular bag b, and the pair of clam shutters 62, 62 projecting from the sealing jaws 61, 61 restrain the tubular bag TB from front and back (left and right in FIG. 13A). FIG. 13A to FIG. 13C are simplified drawings, so they do not show the clam shutters 62, 62.

In the state in FIG. 13A, the nitrogen is pushed down by the air, flows upward through the gap between the first tube member 7 and the tubular packaging material F (the bag TB), and is released to the outside space (see arrow NF3 in FIG. 13A). The downward flow of air indicated by arrows AF1 in FIG. 13A has the role of restraining from above the product M and the fine powder of the product M and the role of accelerating the drop speed of the product M.

Then, the clam shutters 62, 62 close and transverse sealing is performed by the sealing jaws 61, 61. Around the time when transverse sealing ends, a new batch of the product M discharged next from the weighing device W reaches the retention space S above the gate 104. Then, as shown in FIG. 13B, the control unit 10 starts opening the gate 104 and stops the supply of air to the inside space of the first tube member 7. As shown in FIG. 13C, the gate 104 opens completely, and the nitrogen continues to be jetted downward from the discharge outlet 712 in the lower end of the gas flow path 711*a* that is inside the first tube member 7 also when the product M is dropping to the inside space of the tubular packaging material F. For this reason, the nitrogen rises inside the tubular bag TB. The nitrogen rising along the part on the rear side of the inner surface of the bag TB flows en route through the cutout portion 7*a* to the space on the inside of the first tube member 7 (see arrow NF2 in FIG. 13C). For this reason, the nitrogen spreads to both spaces, the space on the inside of the first tube member 7 and the space of the gap between the outside of the first tube member 7 and the inside of the tubular bag TB. As shown in FIG. 13C, the air pushed out by the nitrogen is released through the opening in the upper portion of the first tube member 7, or through the cutout portion 7*a* of the first tube member 7 as indicated by arrow AF2 in FIG. 13C, to the outside from the inside spaces of the first tube member 7 and the tubular bag TB.

Then, at the stage when the batch of the product M dropping through the first tube member 7 is almost contained in the bag b above the transverse sealing unit 6, bagmaking and packaging actions transition from the state shown in FIG. 13C to the state shown in FIG. 13A again. That is, the control unit 10 closes the gate 104 and causes the air supply unit 190 to deliver air from above into the first tube member 7. By repeating the states shown in FIG. 13A to FIG. 13C, the bagmaking and packaging operation is performed.

Figure 11:
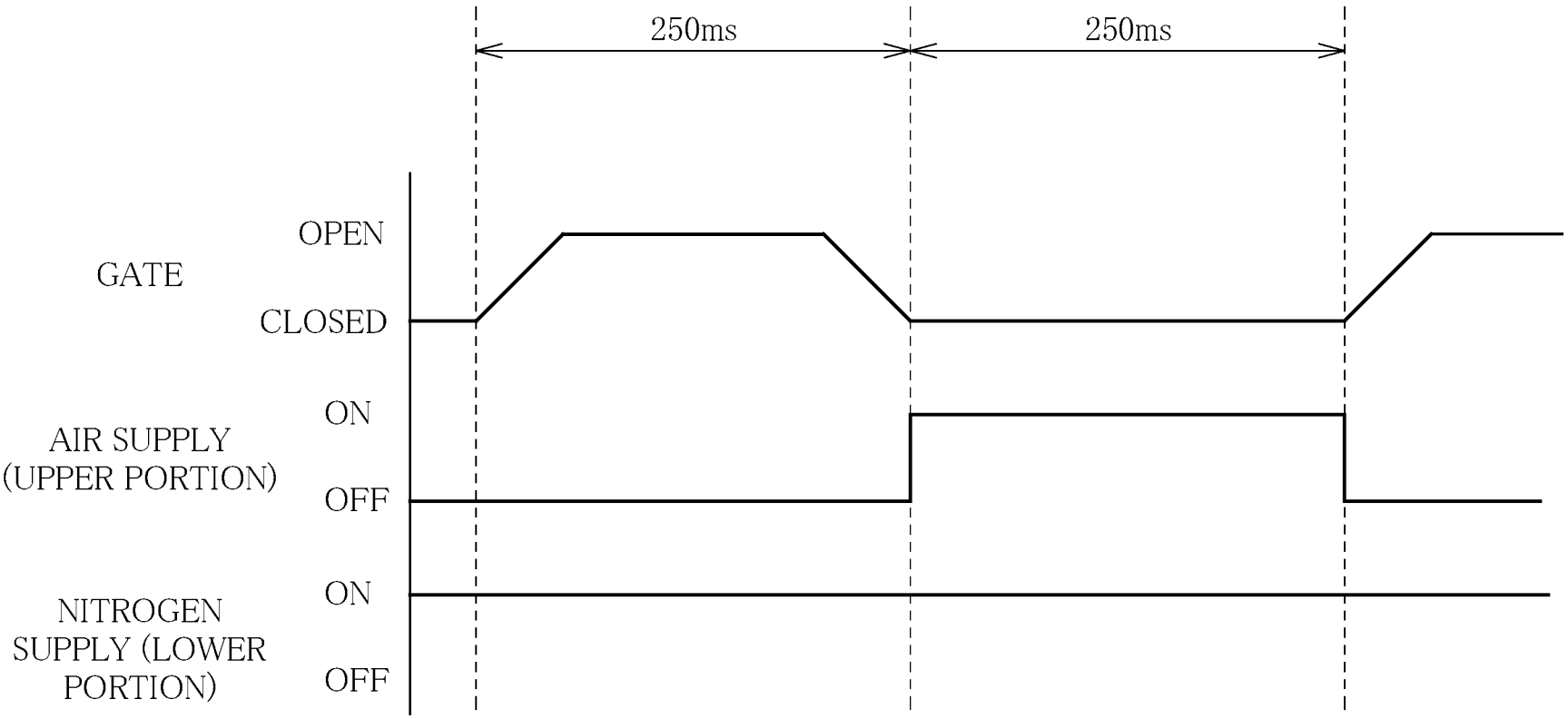
FIG. 11 is a timing diagram of a gate, air supply, and nitrogen supply.

As shown in FIG. 11, in normal operation in which the states shown in FIG. 13A to FIG. 13C are repeated, nitrogen supply is always performed even though the gate alternates between being opened and closed and the air supply unit alternates between being switched on and off.

Furthermore, the air supply quantity, which is the quantity per unit of time of the air delivered to the inside space of the first tube member 7 by the air supply unit 190, is 0.8 times to 1.2 times the nitrogen supply quantity, which is the quantity per unit of time of the nitrogen delivered from the socket 710 through the gas flow path member 711 from the discharge outlet 712 into the tubular bag TB. The nitrogen is always jetted, and the air is intermittently jetted (here, 0.5 second cycles).

(4) Characteristics of Bagmaking and Packaging Device (4-1)

In the bagmaking and packaging device B, the first tube member 7 is provided with the cutout portion 7*a*, and the cutout portion 7*a* serves as a passage for the inert gas (nitrogen). Because of this, the area of the nitrogen in the inside space of the tubular bag TB expands, so that efficient nitrogen replacement is realized. Specifically, the quantity of the nitrogen that ends up flowing from the space of the gap between the first tube member 7 and the tubular bag TB to the outside is reduced.

For this reason, in the bagmaking and packaging device B, the quantity of the nitrogen supplied by the gas supply unit 9 can be reduced and the number of the nitrogen gas cylinders 91 that are used can be reduced.

(4-2)

In the bagmaking and packaging device B, the second tube member 132 is disposed above the inside space of the first tube member 7, and the retention space S is temporarily formed above the first tube member 7. When the retention space S is formed by the gate 104 and the second tube member 132, the top of the inside space of the first tube member 7 is closed off by the gate 104 (see FIG. 13A and FIG. 13B). In this state, supposing that the cutout portion 7*a* is not formed in the first tube member 7, much of the nitrogen delivered into the tubular bag TB heads to the space of the gap between the tubular bag TB and the first tube member 7.

However, in the bagmaking and packaging device B, the first tube member 7 has the cutout portion 7*a*, and the nitrogen can move from the space of the gap between the tubular bag TB and the first tube member 7 via the cutout portion 7*a* to the inside space of the first tube member 7. For this reason, as described above, in the bagmaking and packaging device B, the quantity of the nitrogen supplied by the gas supply unit 9 can be reduced.

(4-3)

In the bagmaking and packaging device B, as shown in FIG. 11 and FIG. 13A, when the gate 104 switches from the open state to the closed state, air is blown downward from above with respect to the inside space of the first tube member 7 (see arrows AF1 in FIG. 13A). Because of this, when the gate 104 switches from the open state to the closed state and the product M that had been temporarily retained in the retention space S is dropping through the inside space of the first tube member 7, the air delivered by the air supply unit 190 accelerates the drop speed of the product M and inhibits variations in the drop speed. Because of this, the bagmaking and packaging cycle time can be shortened and fine powder of the product M can be prevented from getting trapped in the transverse seal portion of the bag b.

(4-4)

Figure 15A:
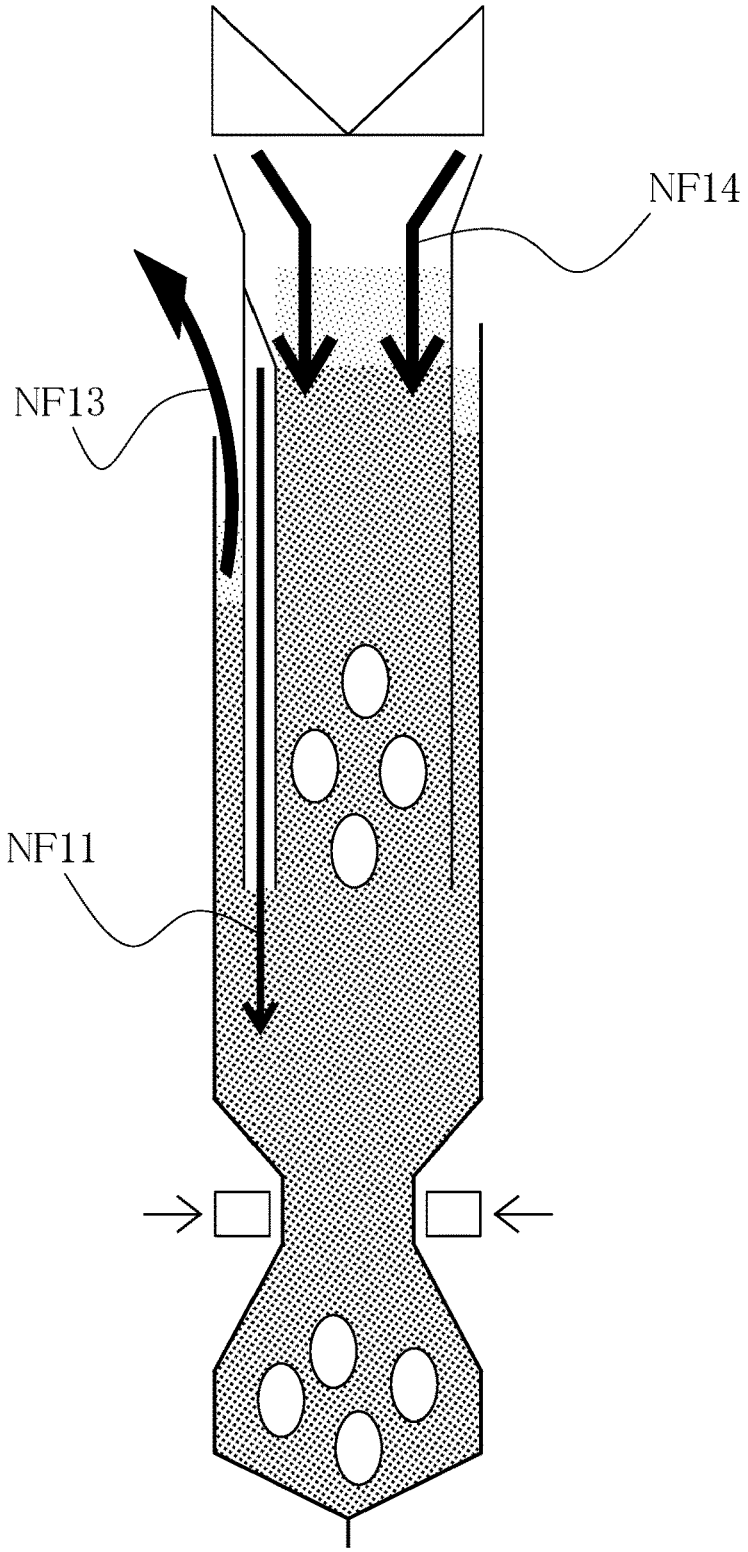
F I G. 15A(PRIOR ART)
FIG. 15A is a drawing showing the jetting and flow of nitrogen during bagmaking and packaging actions in the conventional bagmaking and packaging device.
Figure 15B:
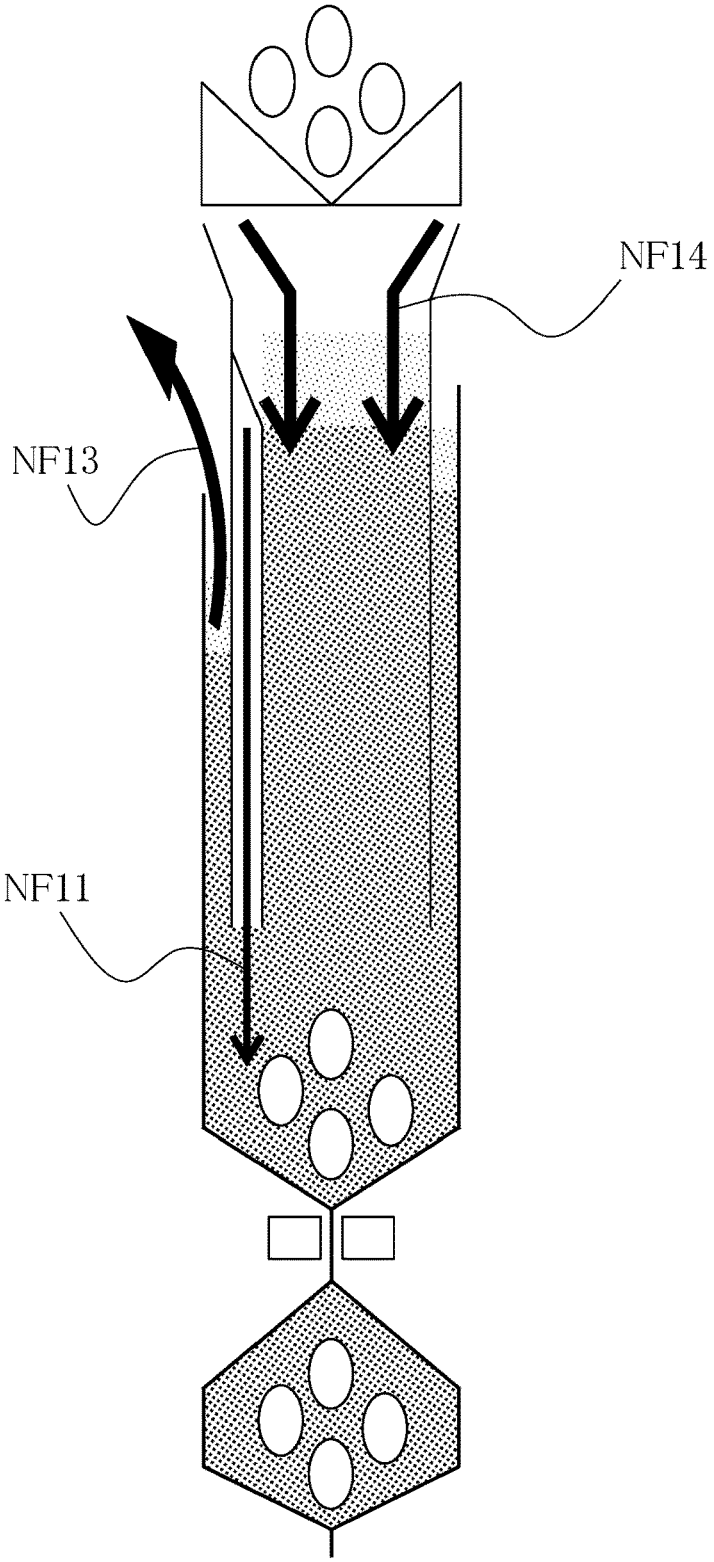
F I G. 15B(PRIOR ART)
FIG. 15B is a drawing showing the jetting and flow of nitrogen during bagmaking and packaging actions in the conventional bagmaking and packaging device.
Figure 15C:
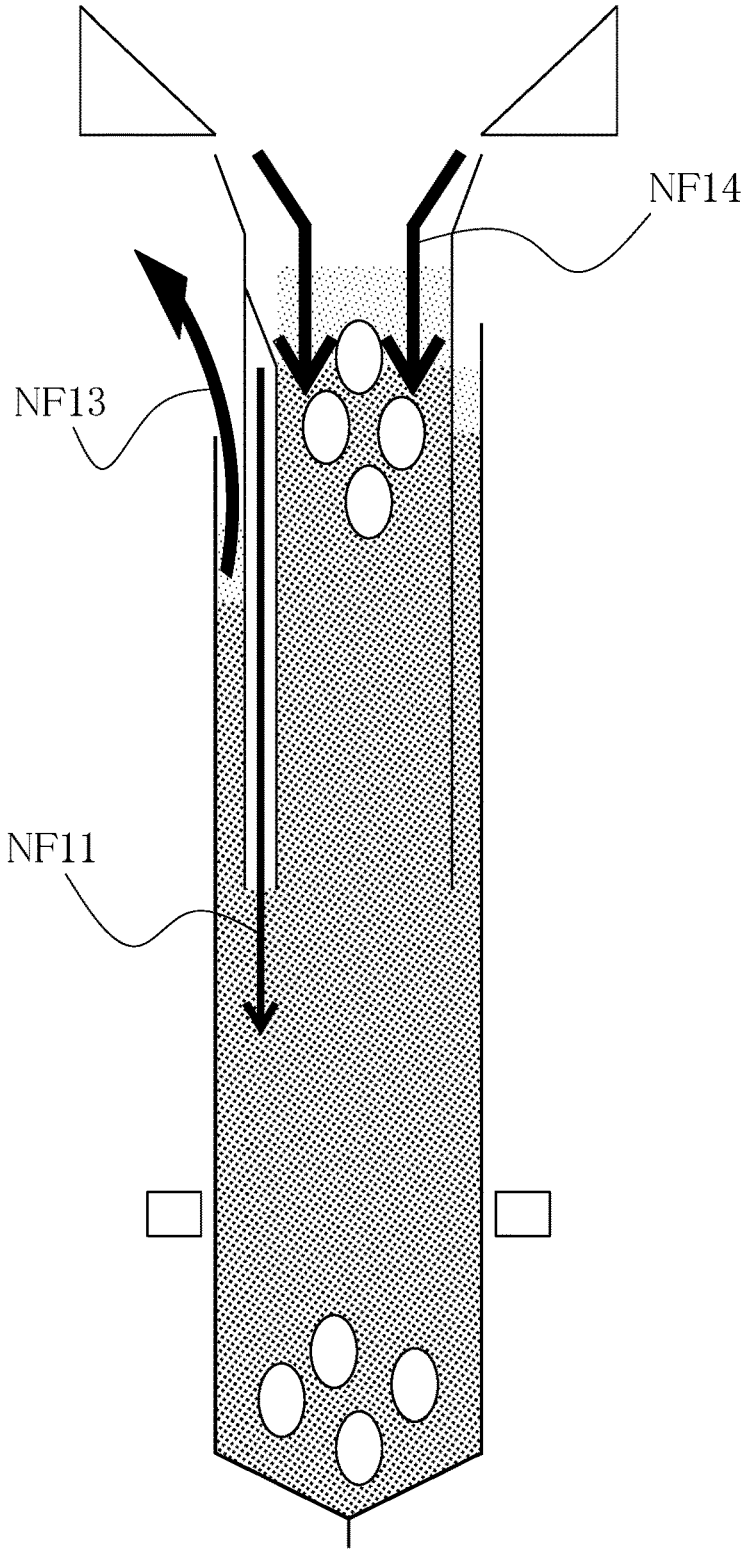
F I G. 15C(PRIOR ART)
FIG. 15C is a drawing showing the jetting and flow of nitrogen during bagmaking and packaging actions in the conventional bagmaking and packaging device.

In the conventional bagmaking and packaging device, the cutout portion is not formed in the first tube member, nitrogen is jetted downward from the discharge outlet in the lower end of the gas flow path that is inside the first tube member (see arrow NF11 in FIG. 15A to FIG. 15C), and nitrogen is also blown downward from above into the inside space of the first tube member (see arrows NF14 in FIG. 15A to FIG. 15C). FIG. 14A, FIG. 14B, and FIG. 15A to FIG. 15C are drawings showing nitrogen replacement in the conventional bagmaking and packaging device. FIG. 14A, FIG. 14B, and FIG. 15A to FIG. 15C correspond to FIG. 12A, FIG. 12B, and FIG. 13A to FIG. 13C showing nitrogen replacement in the bagmaking and packaging device B pertaining to the present invention.

In the conventional bagmaking and packaging device, as indicated by arrows NF14 in FIG. 15A to FIG. 15C, a large quantity of nitrogen is blown downward from above into the first tube member, whereby the drop speed of the product is accelerated and nitrogen replacement is performed.

However, the conventional bagmaking and packaging device has the drawback that the nitrogen ends up flowing through the space of the gap between the first tube member and the tubular bag (the tubular packaging material that is around the first tube member) to the outside (see arrow NF13 in FIG. 15A to FIG. 15C), so that the efficiency of nitrogen replacement is poor.

To address this problem, in the bagmaking and packaging device B pertaining to the above embodiment, the quantity of the nitrogen flowing to the outside is reduced by the cutout portion 7*a* serving as a passage for the nitrogen as described above.

Furthermore, in the bagmaking and packaging device B, the downward blowing of the nitrogen into the inside space of the first tube member that had been performed in the conventional bagmaking and packaging device is done away with, and instead, air is blown downward into the inside space of the first tube member 7. At this time, because the air is jetted in a state in which the gate 104 is closed (see FIG. 13A), the air that is blown downward produces the effect of pushing down the product M from above like a piston rod.

In the bagmaking and packaging device B, the ratio of the air supply quantity per unit of time to the nitrogen supply quantity per unit of time is 0.8 to 1.2. Because of this, in the bagmaking and packaging device B, the use quantity of the nitrogen can be halved compared to the conventional bagmaking and packaging device that uses only nitrogen.

(4-5)

In the bagmaking and packaging device B, as shown in FIG. 4, the cutout portion 7*a* is formed in the first tube member 7 in such a way as to extend upward from the lower end of the first tube member 7. For this reason, machining of the first tube member 7 when forming the cutout portion 7*a* becomes easy to perform, and fewer man-hours are needed to manufacture the first tube member 7.

(4-6)

In the bagmaking and packaging device B, as shown in FIG. 5, the transverse section of the first tube member 7 at a height position of the part where the cutout portion 7*a* is formed is substantially C-shaped. For this reason, it is ensured that the first tube member 7 is high in strength.

If the transverse section of the first tube member were semicircular in shape so the first tube member had the shape of a half-tube, there would be concern that the bag would narrow at its end and its capacity would be reduced when the clam shutters close. Then, the product M such as potato chips would accumulate and get trapped in the transverse seal portion.

(5) Example Modifications (5-1)

In the bagmaking and packaging device B of the above embodiment, the product M such as potato chips is assumed, the air supply unit 190 is provided for the purpose of pushing down the product M from above with air, and the air is blown downward with respect to the inside space of the first tube member 7.

However, there are also products that do not need assistance from air to drop. In a bagmaking and packaging device where that type of product is the contents, the air supply unit 190 can be omitted.

(5-2)

In the bagmaking and packaging device B of the above embodiment, air is blown downward with respect to the inside space of the first tube member 7, but in a case where importance is attached to improvement of the nitrogen replacement rate and/or the speed of nitrogen replacement, nitrogen may also be blown down with respect to the inside space of the first tube member 7 instead of air. In this case, nitrogen is jetted into the tubular bag TB from the discharge outlet 712 in the lower end of the first tube member 7 and nitrogen is also blown downward from above the first tube member 7 with respect to the inside space of the first tube member 7.

(5-3)

In the bagmaking and packaging device B of the above embodiment, the gate 104 is closed during the latter half of the flushing before commencement of operation (see FIG. 12A). However, depending on the size of the cutout portion 7*a* of the first tube member 7, it is also a concern that flushing will require a long time.

Therefore, control to perform the flushing in a state in which there is no product M on the gate 104 and to always open the gate 104 during the flushing may also be performed. When the gate 104 is left open and nitrogen is blown into the tubular bag TB from the discharge outlet 712 in the lower end of the gas flow path 711*a*, the nitrogen flowing to the space in the lower portion of the bag TB flows upward through the inside space of the first tube member 7 and escapes upward through the opening in the upper end of the first tube member 7. By performing this kind of flushing control, the air is quickly pushed out upward by the nitrogen, and the space in the bag TB including the inside space of the first tube member 7 is replaced with nitrogen in a short amount of time. That is, by opening the gate 104, a large passage for gas (air) is formed inside the first tube member 7 and nitrogen replacement is promoted. Consequently, according to this example modification, nitrogen replacement in the bag TB can be concluded with a relatively small nitrogen supply quantity.

(5-4)

In the bagmaking and packaging device B of the above embodiment, as shown in FIG. 5, the transverse section of the first tube member 7 is substantially C-shaped, but as concerns the circumferential direction width dimension of the cutout portion 7*a* of the first tube member 7, there are optimal values depending on the diameter of the first tube member 7. The width dimension may be made smaller than the dimension shown in FIG. 5, or may made a little larger. Furthermore, two cutout portions 7*a* may also be formed in the first tube member 7.

REFERENCE SIGNS LIST

6 Transverse Sealing Unit
7 First Tube Member (Tube Member for Bagmaking and Packaging Device)
7*a* Cutout Portion
9 Gas Supply Unit
10 Control Unit
100 Filling Unit
103 Chute
104 Gate (Opening/Closing Member)
132 Second Tube Member
190 Air Supply Unit (Air Delivery Unit)
200 Weighing and Packaging System
711 Gas Flow Path Member (Inert Gas Flow Path Member)
b Bag
B Bagmaking and Packaging Device
F Packaging Material
M Product (Contents)
S Retention Space
TB Bag Formed into Tubular Shape

What is claimed is:

1. A bagmaking and packaging device comprising:

a transverse sealing unit that transversely seals a packaging material formed into a tubular shape;

a first tube member that is disposed above the transverse sealing unit, extends in an up and down direction, allows the packaging material to become wrapped around it to thereby form the packaging material into the tubular shape, and guides downward contents entering the first tube member from above; and an inert gas flow path member at least part of which is disposed inside the first tube member and is configured to deliver an inert gas into the packaging material formed into the tubular shape, wherein the first tube member includes a slot that extends in the up and down direction so that the inert gas rising in a space between the packaging material formed into the tubular shape and the first tube member flows en route through the slot to the space inside the first tube member; and wherein any transverse section of the first tube member where the slot is formed is closed C-shaped with exposed terminal edges of the walls of the first tube member on either side of the slot facing each other, and wherein a distance between the terminal edges of the walls which face each other is substantially constant along an entire length of the slot.

2. The bagmaking and packaging device of claim 1, further comprising a second tube member that is disposed above the first tube member and an opening/closing member that is disposed above the first tube member, the opening/closing member and the second tube member forming a retention space for temporarily retaining the contents.

3. The bagmaking and packaging device of claim 2, further comprising an air delivery unit that delivers air from above to the inside space of the first tube member and a control unit that controls the air delivery unit and the opening/closing member, wherein the control unit, when it has switched the opening/closing member from an open state to a closed state, uses the air delivery unit to deliver air to the inside space of the first tube member.

4. The bagmaking and packaging device of claim 3, wherein an inert gas supply quantity, which is the quantity per unit of time of the inert gas delivered into the packaging material formed into the tubular shape, is 0.8 times to 1.2 times an air supply quantity, which is the quantity per unit of time of the air delivered to the inside space of the first tube member by the air delivery unit.

5. The bagmaking and packaging device of claim 1, wherein the slot extends upward from a lower end of the first tube member.

6. A tube member for a bagmaking and packaging device that guides downward contents entering the tube member from above and allows a packaging material to become wrapped around it to thereby form the packaging material into a tubular shape, the tube member including a slot that extends in an up and down direction so that an inert gas delivered into the packaging material formed into the tubular shape and rising in a space between the packaging material formed into the tubular shape and the tube member flows en route through the slot to the space inside the tube member, wherein any transverse section of the tube member where the slot is formed is closed C-shaped with exposed terminal edges of the walls of the tube member on either side of the slot facing each other, and wherein a distance between the terminal edges of the walls which face each other is substantially constant along an entire length of the slot.

7. The tube member for a bagmaking and packaging device of claim 6, wherein the slot extends upward from a lower end of the tube member.

* * * * *